US007278797B2

(12) United States Patent
Akaiwa et al.

(10) Patent No.: US 7,278,797 B2
(45) Date of Patent: Oct. 9, 2007

(54) TAPE PRINTING APPARATUS AND TAPE CARTRIDGE

(75) Inventors: Masao Akaiwa, Nagano-ken (JP); Nobuyuki Horii, Tokyo (JP)

(73) Assignees: Seiko Epson Corporation, Tokyo (JP); King Jim Co., Ltd., Tokyo (JP)

( * ) Notice: Subject to any disclaimer, the term of this patent is extended or adjusted under 35 U.S.C. 154(b) by 27 days.

(21) Appl. No.: 11/150,531

(22) Filed: Jun. 10, 2005

(65) Prior Publication Data

US 2005/0226670 A1 Oct. 13, 2005

Related U.S. Application Data

(62) Division of application No. 10/747,880, filed on Dec. 29, 2003, now abandoned.

(30) Foreign Application Priority Data

Jan. 17, 2003 (JP) ..... 2003-010091

(51) Int. Cl.
*B41J 11/00* (2006.01)
*B41J 15/00* (2006.01)

(52) U.S. Cl. ..... 400/613; 400/611; 400/609; 400/615.2

(58) Field of Classification Search ..... 400/609, 400/611, 613, 615.2
See application file for complete search history.

(56) References Cited

U.S. PATENT DOCUMENTS 5,538,577 A * 7/1996 Negoro ..... 156/235
6,585,438 B2 7/2003 Hosokawa et al.
6,648,532 B2 11/2003 Furuya et al.
6,666,593 B2 * 12/2003 Akaiwa ..... 400/61
2002/0090243 A1 * 7/2002 Hosokawa et al. ..... 400/613
2002/0154933 A1 * 10/2002 Kalette ..... 400/615.2
2002/0197090 A1 12/2002 Akaiwa

FOREIGN PATENT DOCUMENTS

| | | |
|---|---|---|
| CN | 1383991 | 12/2002 |
| JP | 5-446 | 1/1993 |
| JP | 2000-289312 | 10/2000 |
| JP | 2000-301797 | 10/2000 |
| KR | 2002-0025792 | 4/2002 |

* cited by examiner

*Primary Examiner*—Daniel J. Colilla
*Assistant Examiner*—Marissa Ferguson-Samreth
(74) *Attorney, Agent, or Firm*—Hogan & Hartson LLP

(57) ABSTRACT

A label to be attached to a linear or bar-shaped object is created by printing on a translucent printing tape and cutting off a printed tape part in a width direction of the printing tape. For creating the label, the printed tape part is divided parallel to its longitudinal direction and a print region where printing is performed is set. Printing is performed in the print region and the printed tape part is cut off. This region setting is performed in such a manner that the print region is overlaid with a non-print region, i.e., a non-print part in attaching the label around the object from an edge portion of the printed tape part in its width direction.

3 Claims, 21 Drawing Sheets

〈TAPE VERTICAL DIRECTION, TRANSPARENT TAPE〉

〈TAPE VERTICAL DIRECTION, TRANSPARENT TAPE WITH BACKGROUND COLOR〉

〈TAPE HORIZONTAL DIRECTION, TRANSPARENT TAPE〉

〈TAPE VERTICAL DIRECTION, HALF-CUT TRANSPARENT TAPE〉

〈TAPE HORIZONTAL DIRECTION, TRANSPARENT TAPE, HALF-CUT PRESENT〉

〈TAPE VERTICAL DIRECTION, TRANSPARENT TAPE〉

TAPE PRINTING APPARATUS AND TAPE CARTRIDGE

This is a divisional of application Ser. No. 10/747,880 filed Dec. 29, 2003, now abandoned which application is hereby incorporated by reference in its entirety.

BACKGROUND OF THE INVENTION

1. Field of the Invention

The present invention relates to a tape printing apparatus capable of creating a label to be attached to a linear or bar-shaped object, and also relates to a tape cartridge.

2. Description of the Related Art

There has been heretofore known an apparatus which creates a label to be attached to an object (a cylindrical object) such as a linear object (cables, leads and the like) and a bar-shaped object (writing utensils, a handle of an umbrella and the like).

In such a conventional apparatus, a cylindrical heat-shrinkable tape (a member thermally shrunk to have a predetermined memory shape by heating) is used as a print medium. Thus, the apparatus has an advantage in that the tape does not easily come off when attached to the linear or bar-shaped object.

However, a label created by this kind of apparatus is not coated or laminated and, therefore, a print surface thereof is exposed on its surface. Thus, there was a problem in that the label is severely worn away, resulting in poor durability. Therefore, after having attached a heat-shrinkable tape to an object and then subjecting it to thermal shrinking, a laminate tape must further be attached to the print surface in order to protect the print surface.

SUMMARY OF THE INVENTION

In view of the above-described problem, it is an advantage of the present invention to provide a tape printing apparatus capable of creating a label to be attached to a linear or bar-shaped object and to provide a tape cartridge. Specifically, the label is excellent in abrasion resistance and rubfastness (i.e., characteristics to withstand rubbing).

According to the present invention, there is provided a tape printing apparatus which creates a label to be attached to a linear or bar-shaped object by printing on a translucent printing tape and cutting a printed tape part in a width direction of the printing tape. The tape printing apparatus comprises: region setting means for setting a print region where printing is performed by marking off the printed tape part parallel to its longitudinal direction; print means for printing the print region; and cutting means for cutting off the printed tape part. The region setting means sets the print region such that, when the label is attached around the object from an edge portion of the printed tape part in its width direction, the print region is overlaid with a non-print region which is a non-print part.

According to the above arrangement, when the label is attached around the linear or bar-shaped object from the edge portion of the printed tape part in its width direction, the print region is set so as to be overlaid with the non-print region that is the non-print part. Thus, the abrasion resistance and the rubfastness of the label (the print region) can be improved. Moreover, since the printing tape is translucent, visibility of the print region is not diminished.

According to another aspect of the present invention, there is provided a tape printing apparatus which creates a label to be attached to a linear or bar-shaped object by performing printing in a print region of a printing tape and cutting a printed tape part in a width direction of the printing tape. The printing tape is divided parallel to a longitudinal direction thereof into the print region which has a background color and where printing is performed and a non-print region which has translucency and where printing is forbidden. The tape printing apparatus comprises: print means for printing the print region; print forbidding means for forbidding printing of the non-print region; and cutting means for cutting off the printed tape part.

According to the above arrangement, since printing is performed in the print region having the background color, visibility of printed characters and images is not diminished by a color of the object which serves as a base. Moreover, when the label is attached to the linear or bar-shaped object, the label is attached in such a manner that the print region is overlaid with the non-print region having the translucency. Thus, the abrasion resistance and the rubfastness of the label (the print region) can be improved.

Preferably, the print region and the non-print region are laid out in the printing tape such that, when the label is attached around the object from an edge portion of the printed tape part in its width direction, the print region is overlaid with the non-print region.

According to the above arrangement, the print and non-print regions are laid out in such a manner that the print region is overlaid with the non-print region. Thus, when the label is attached to the object, the abrasion resistance and the rubfastness of the label (the print region) can be surely improved.

According to another aspect of the present invention, there is provided a tape printing apparatus which creates a label to be attached to a linear or bar-shaped object by printing on a translucent printing tape and cutting a printed tape part in a width direction of the printing tape. The tape printing apparatus comprises: region setting means for setting a print region where printing is performed by marking off the printed tape part parallel to its width direction; print means for printing the print region; and cutting means for cutting off the printed tape part. The region setting means sets the print region such that, when the label is attached around the object from an edge portion of the printed tape part in its longitudinal direction, the print region is overlaid with a non-print region which is a non-print part.

According to the above arrangement, the print region is set such that, when the label is attached around the linear or bar-shaped object from the edge portion of the printed tape part in its longitudinal direction, the print region is overlaid with the non-print region that is the non-print part. Thus, the abrasion resistance and the rubfastness of the label (the print region) can be improved. Moreover, since the printing tape is translucent, visibility of the print region is not diminished. Furthermore, by marking off the printed tape part parallel to its width direction, a length thereof in its longitudinal direction can be arbitrarily set. Thus, it is possible to create a label which can be also attached to an object having a large diameter.

Preferably, the printing apparatus further comprises input means for inputting characters, and print data generation means for generating print data based on inputted characters. The region setting means sets at least one of a length of the print region and a length of the non-print region in the longitudinal direction based on the print data.

According to the above arrangement, the length of the print region and/or the length of the non-print region in the longitudinal direction are set based on the generated print data. Thus, even if the number of characters to be printed is large, the print region can be set so as to be surely overlaid with the non-print region.

Preferably, the tape printing apparatus further comprises object size input means for inputting an object size in a form of a diameter or circumference of the object. The region setting means sets at least one of a length of the print region and a length of the non-print region in the longitudinal direction based on the object size.

According to the above arrangement, the length of the print region and/or the length of the non-print region in the longitudinal direction are set based on the inputted object size. Thus, even if the diameter of the object is large, the print region can be set so as to be surely overlaid with the non-print region.

Preferably, the tape printing apparatus further comprises: region disposition means for disposing the two regions of print region and non-print region on the tape. The region disposition means disposes the print region on an upstream side of the non-print region along a feed direction of the printing tape.

According to the above arrangement, the print region is disposed in the on an upstream side of the non-print region along the feed direction of the printing tape. Thus, without wasting the printing tape, printing can be performed up to the vicinity of a tape end (a tape rear end). Specifically, when the print region is disposed on a downstream side of the non-print region, usually, a print position is located on an upstream side of a cutting position and the print position is set as a print starting position. Thus, there arises any one of the following two problems. Specifically, printing cannot be performed for a length between the print position and the cutting position from a tape front end, thereby causing an unnecessary region for the length. The other problem is that, after printing, the tape is wasted by cutting the tape for the length between the print position and the cutting position. However, according to the arrangement described above, such problems can be resolved.

According to another aspect of the present invention, there is provided a tape printing apparatus which creates a label to be attached to a linear or bar-shaped object by performing printing in a print region of a printing tape and cutting a printed tape part in a width direction of the printing tape. The printing tape is divided parallel to the width direction into the print region which has a background color and where printing is performed and a non-print region which has translucency and where printing is forbidden. The tape printing apparatus comprises: print means for printing the print region; print forbidding means for forbidding printing of the non-print region; and cutting means for cutting off the printed tape part.

According to the above arrangement, since printing is performed in the print region having the background color, visibility of printed characters and images is not diminished by a color of the object to be a base. Moreover, when the label is attached to the linear or bar-shaped object, the label is attached in such a manner that the print region is overlaid with the non-print region having the translucency. Thus, the abrasion resistance and the rubfastness of the label (the print region) can be improved. Furthermore, by marking off the printed tape part parallel to its width direction, a length thereof in its longitudinal direction can be arbitrarily set. Thus, it is possible to create a label which can be also attached to a bar-shaped object having a large diameter.

Preferably, the printing tape has a structure in which a base material layer and the release paper layer are laminated. The tape printing apparatus further comprises half-cut (or half cutting) means for cutting off only a release paper layer. The half-cut means half-cuts a boundary portion between the print region and the non-print region in the longitudinal direction of the printing tape.

According to the above arrangement, the boundary portion between the print region and the non-print region is half-cut (or is subjected to half cutting) in the longitudinal direction of the printing tape. Thus, if the release paper layer only in the non-print region is released and the label is attached in such a manner that the print region is overlaid with the non-print region, the release paper layer becomes a base in the print region. Consequently, even if the entire surface of the printing tape is translucent, visibility of printed characters and images is not diminished by a color of the object.

Preferably, the region setting means marks off the printed tape part parallel to its longitudinal direction and sets an attachment base region in an edge portion at the print region side. The attachment base region is a base point in attaching the printing tape to the object. The half-cut means half-cuts a boundary portion between the attachment base region and the print region.

According to the above arrangement, the release paper layer in the non-print region and the attachment base region is released and the label is attached around the object by using the attachment base region as the base point. Thus, it is possible to attach the label easily and accurately without displacing the base point.

Preferably, the printing tape has a half-cut means for cutting off only a release paper layer and the printing tape has a structure in which a base material layer and the release paper layer are laminated. The half-cut means half-cuts a boundary portion between the print region and the non-print region in the width direction of the printing tape.

According to the above arrangement, the boundary portion between the print region and the non-print region is half-cut in the width direction of the printing tape. Thus, if the release paper layer only in the non-print region is released and the label is attached in such a manner that the print region is overlaid with the non-print region, the release paper layer becomes a base in the print region. Consequently, even if the entire surface of the printing tape is translucent, visibility of printed characters and images is not diminished by a color of the object.

Preferably, the region setting means further marks off the printed tape part parallel to its width direction and sets an attachment base region in an edge portion at the print region side. The attachment base region is a base point in attaching the printing tape to the object. The half-cut means further half-cuts a boundary portion between the attachment base region and the print region.

According to the above arrangement, the release paper layer in the non-print region and the attachment base region is released and the label is attached around the object by using the attachment base region as the base point. Thus, it is possible to attach the label easily and accurately without displacing the base point.

According to another aspect of the present invention, there is provided a tape cartridge which houses a translucent printing tape in its rolled state. The printing tape becomes a label to be attached to a linear or bar-shaped object when a printed tape part is cut off in its width direction after printing. The printing tape is divided parallel to its longitudinal direction into a print region where printing is performed and a non-print region where printing is forbidden, and a boundary portion between the print region and the non-print region is half-cut.

According to the above arrangement, in attaching the printed tape to the linear or bar-shaped object, the tape is attached in such a manner that the print region is overlaid with the non-print region. Thus, the abrasion resistance and the rubfastness of the label (the print region) can be improved. Moreover, since the boundary portion between the print region and the non-print region is half-cut, if a release paper layer only in the non-print region is released and the tape is attached to the object, the release paper layer becomes a base in the print region. Thus, even if the entire surface of the printing tape is translucent, visibility of printed characters and images is not diminished by a color of the object.

Preferably, the printing tape is further divided parallel to its longitudinal direction and comprises an attachment base region which is a base point in attaching the printing tape to the object. A boundary portion between the attachment base region and the print region is also further half-cut.

According to the above arrangement, the release paper layer in the non-print region and the attachment base region is released and the tape is attached around the object by using the attachment base region as the base point. Thus, it is possible to provide a label which can be attached easily and accurately without displacing the base point.

According to another aspect of the present invention, there is provided a tape cartridge which houses a translucent printing tape in its rolled state. The printing tape becomes a label to be attached to a linear or bar-shaped object when a printed tape part is cut off in its width direction after printing. The printing tape is divided parallel to its width direction into a print region where printing is performed and a non-print region where printing is forbidden and a boundary portion between the print region and the non-print region is half-cut.

According to the above arrangement, in attaching the printed tape to the linear or bar-shaped object, the tape is attached in such a manner that the print region is overlaid with the non-print region. Thus, the abrasion resistance and the rubfastness of the label (the print region) can be improved. Moreover, since the boundary portion between the print region and the non-print region is half-cut, if a release paper layer only in the non-print region is released and the tape is attached to the object, the release paper layer becomes a base in the print region. Thus, even if the entire surface of the printing tape is translucent, visibility of printed characters and images is not diminished by a color of the object. Furthermore, since the printing tape is divided parallel to its width direction, a length thereof in its longitudinal direction can be arbitrarily set. Therefore, it is possible to provide a label which can be also attached to an object having a large diameter.

Preferably, in the printing tape, the print region is disposed on an upstream side of the non-print region along a feed direction of the printing tape.

According to the above arrangement, the print region is disposed on the upstream side of the non-print region along the feed direction of the printing tape. Thus, without wasting the printing tape, it is possible to provide a printing tape which can be printed up to the vicinity of a tape end (a tape rear end). Specifically, when the print region is disposed on a downstream side of the non-print region, usually, a print position is located on an upstream side of a cutting position and the print position is set as a print starting position. Thus, there arises any one of the following two problems. Specifically, printing cannot be performed for a length between the print position and the cutting position from a tape front end, thereby causing an unnecessary region for the length. The other problem is that, after printing, the tape is wasted by cutting the tape for the length between the print position and the cutting position. However, according to the arrangement described above, such problems can be resolved.

Preferably, the printing tape is further divided parallel to its width direction and comprises an attachment base region in an edge portion at the print region side. The attachment base region is a base point in attaching the printing tape to the object. A boundary portion between the attachment base region and the print region is also further half-cut.

According to the above arrangement, the release paper layer in the non-print region and the attachment base region is released and the tape is attached around the object by using the attachment base region as the base point. Thus, it is possible to provide a label which can be attached easily and accurately without displacing the base point.

Preferably, the tape cartridge further comprises an ink ribbon for transferring ink onto the printing tape. The ink ribbon is housed in the tape cartridge in its rolled state and a width of the ink ribbon is equal to a length of the print region in a tape width direction.

According to the above arrangement, since the width of the ink ribbon is equal to the length of the print region in the tape width direction, manufacturing costs can be reduced. Specifically, the tape cartridge according to the present invention is one for printing only in the print region and thus does not require an ink ribbon having the same width as a tape width including a width of the non-print region. Thus, costs required for the ink ribbon can be reduced.

Preferably, the tape cartridge further comprises an ink ribbon for transferring ink onto the printing tape. The ink ribbon is housed in the tape cartridge in its rolled state and a width of an ink-coated area is equal to the length of the print region in the tape width direction.

According to the above arrangement, since the width of the ink ribbon is equal to the length of the print region in the tape width direction, the manufacturing costs can be reduced. Specifically, since the tape cartridge according to the present invention is one for printing only in the print region, it is not required to apply ink for the same width as the tape width including the width of the non-print region. Thus, the costs required for the ink ribbon can be reduced.

Preferably, the tape cartridge further comprises a platen roller which faces a print head and presses the printing tape against the print head in printing. A width of a press region in which the platen roller presses the printing tape is equal to the length of the print region in the tape width direction.

According to the above arrangement, since the width of the press region in which the platen roller presses the printing tape is equal to the length of the print region in the tape width direction, the cartridge arrangement can be miniaturized. Specifically, the tape cartridge according to the present invention is one for printing only in the print region and thus does not require a platen roller having the same width as the tape width including the width of the non-print region. Consequently, the platen roller can be miniaturized and thus the tape cartridge can be miniaturized.

Preferably, an area ratio of the print region to the non-print region is 1:3 to 1:4.

According to the above arrangement, since the area ratio of the print region to the non-print region is 1:3 to 1:4, in attaching the label to the object, the print region can be surely overlaid with the non-print region. Thus, the abrasion resistance and the rubfastness of the label can be further improved.

BRIEF DESCRIPTION OF THE DRAWINGS

The above and other objects and the attendant features of this invention will become readily apparent by reference to the following detailed description when considered in conjunction with the accompanying drawings wherein.

DETAILED DESCRIPTION OF THE PREFERRED EMBODIMENTS

With reference to the accompanying drawings, a tape printing apparatus and a tape cartridge according to an embodiment of the present invention will be described below in detail. The tape printing apparatus according to this embodiment creates a label to be attached to a linear or bar-shaped (cylindrical) object by printing on a translucent printing tape and cutting off a printed tape part in a width direction of the printing tape.

Figure 1:
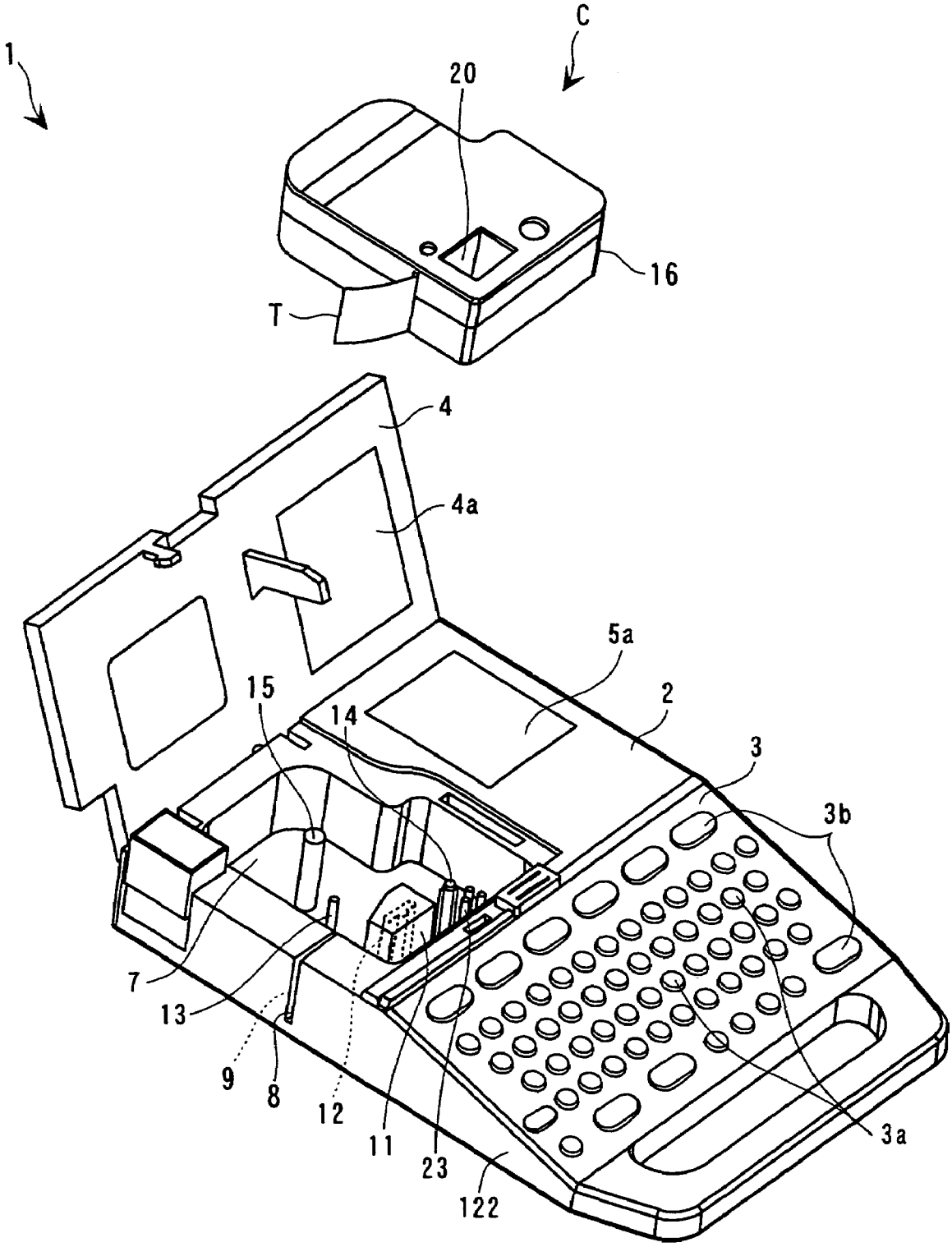
FIG. 1 is an external perspective view of a tape printing apparatus having its cover opened according to one embodiment of the present invention.

FIG. 1 is an external perspective view of a tape printing apparatus 1 in a state in which a cover thereof is opened. As shown in FIG. 1, an external shape of the tape printing apparatus 1 is formed by a printer case 2 which is divided into an upper half and a lower half. In an upper front portion of the printer case 2, a keyboard 3 including various input keys is disposed. In an upper rear portion thereof, an opening and closing cover 4 is provided. Inside of the opening and closing cover 4, a display screen 5*a* is provided and a cartridge mounting part 7 for mounting a tape cartridge C is formed in a hollow shape. The tape cartridge C is detachably mounted in the cartridge mounting part 7 in a state in which the opening and closing cover 4 is opened. Moreover, on the opening and closing window 4, there is formed an observation window 4*a* for viewing the display screen 5*a* in a state in which the opening and closing cover 4 is closed.

In the keyboard 3, a character key group 3*a*, a function key group 3*b* and the like are arranged. The functional key group 3*b* is for specifying various operation modes and the like. The character key group 3*a* has a full key arrangement based on Japanese Industrial Standards (JIS) sequence and comprises a shift key for suppressing increase in the number of keys to be operated, similar to a general word processor or the like. Moreover, the function key group 3*b* includes: a print mode key for setting any one of print modes which are "cylinder label mode" for creating a label to be attached to a linear or bar-shaped (cylindrical) object and "normal mode" for creating a label to be attached to a normal planar object; a style key for setting a character direction, a character size and the like; a cancel key for canceling processing by other function keys and the like; cursor keys for cursor movement; a print key for starting a print operation; a selection key for selection of various modes and for line feed in text input; and the like.

Moreover, the display screen 5*a* includes: an indicator part for displaying a function executed at the present stage; and a main display part. In the indicator part, following states are displayed in a viewable state, including: a print mode state which is any one of "cylinder label mode" and "normal mode"; a style state such as "character direction" and "character size"; an input mode state such as "Roman character input" and "Kana input"; and format setting state such as "equal layout" and "forward justification". Moreover, the main display part displays input contents from the keyboard 3. The displayed contents can be freely controlled. When a predetermined key input is made, a layout of a current print image can be displayed. Moreover, by using microswitches 23, information such as a type of a tape cartridge (whether or not a tape cartridge is to be exclusively used for a cylindrical label: details will be described later), a type of a tape (tape width, tape color, ink color and the like) or the like is also displayed.

In a left side portion of the printer case 2, a tape ejection opening 8 is formed, which connects the cartridge mounting part 7 with the outside. In this tape ejection opening 8, a tape cutter 9 for cutting off the ejected printing tape T is disposed.

When the printed printing tape T is ejected from the tape ejection opening 8, this printed printing tape T is cut off by the tape cutter 9.

In the cartridge mounting part 7, included are: a thermal head 12 which is covered with a head cover 11 and has heater elements; a platen drive shaft 13 which faces the thermal head 12; a reel drive shaft 14 which reels an ink ribbon R to be described later; and a positioning protrusion 15 of a tape reel 17 to be described later. Moreover, at a bottom of the cartridge mounting part 7, a tape feed mechanism for rotating the platen drive shaft 13 and the reel drive shaft 14 is installed.

Figure 2A:
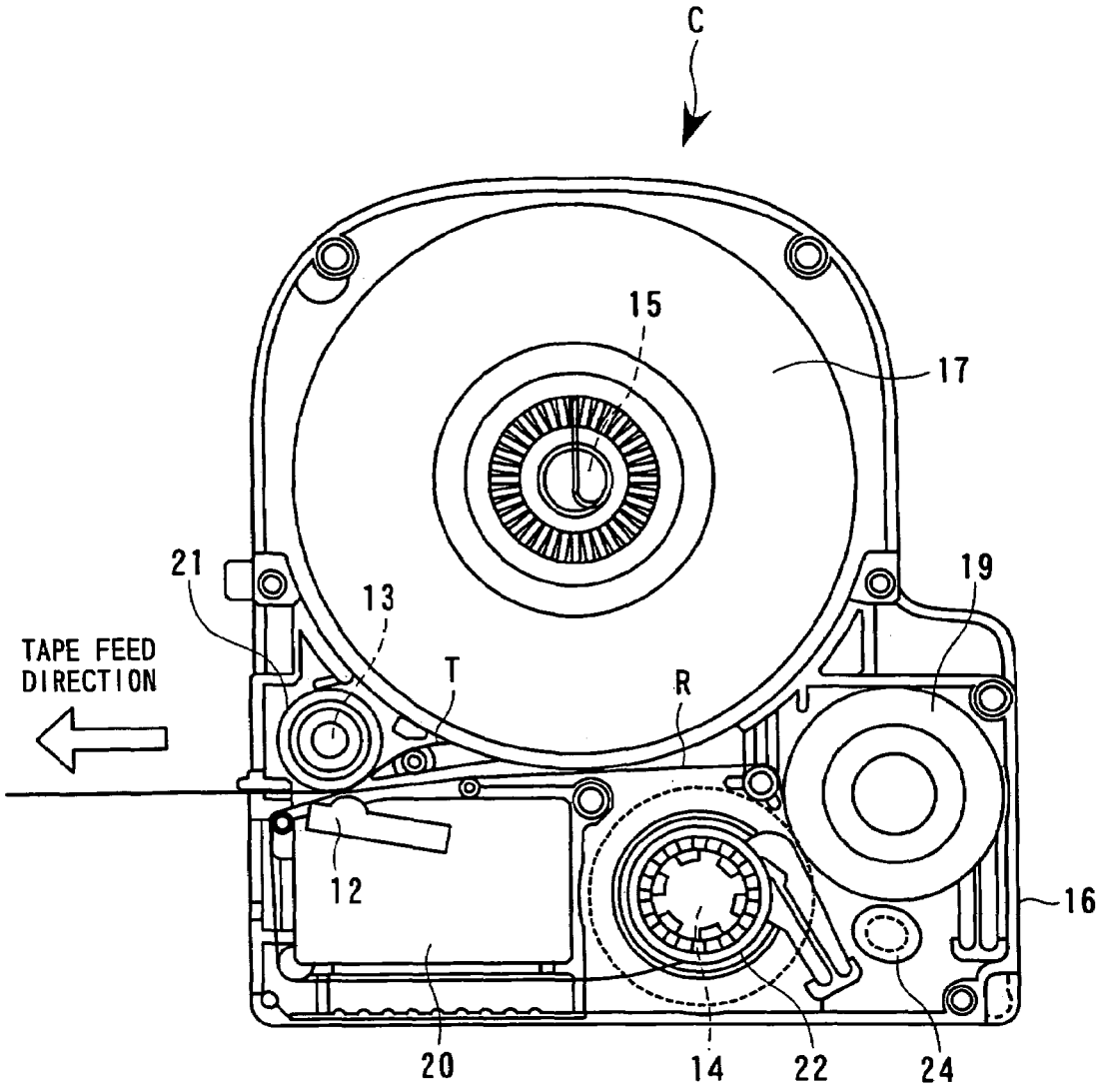
FIGS. 2A and 2B are cross-sectional views of a tape cartridge.

FIG. 2A shows a cross-section of the tape cartridge C. As shown in FIG. 2A, inside a cartridge case 16, the tape reel 17 having the printing tape T rolled is housed in an upper center portion (as seen in the figure) and a ribbon reel 19 having the ink ribbon R rolled is housed in a lower right portion. The printing tape T and the ink ribbon R have the same width. Moreover, in a lower left portion of the tape reel 17, a through hole 20 for inserting the head cover 11 is formed. Corresponding to a part where the printing tape T and the ink ribbon R meet, a platen roller 21 is disposed, which is fitted into the platen drive shaft 13 and rotatably driven. A ribbon take-up reel 22 is disposed close to the ribbon reel 19. The ink ribbon R let out from the ribbon reel 19 is disposed around the head cover 11 and rolled up (or taken up) by the ribbon take-up reel 22.

When the tape cartridge C is mounted in the cartridge mounting part 7, the head cover 11, the positioning protrusion 15 and the reel drive shaft 14 are inserted into the through hole 20, a center hole of the tape reel 17 and a center hole of the ribbon take-up reel 22, respectively. Accordingly, the printing tape T and the ink ribbon R are sandwiched therebetween and the thermal head 12 abuts on the platen roller 21, thereby making it possible to effect printing.

As to the printing tape T, many types of tapes are prepared, which are different in tape types (tape width, tape color, ink color and the like). A plurality of identifiers 24 which indicate these types are provided in the cartridge case 16. The identifiers 24 include a plurality of small holes formed on an exterior surface of the tape cartridge C. Corresponding to these identifiers 24, a plurality of microswitches (detection ends) 23 are provided in the cartridge mounting part 7, which detect the type of the tape in accordance with the presence and number of the identifiers 24. A length of protrusion of each microswitch 23 coincides with a depth of each identifier 24. A microswitch 23 which enters a shallow identifier 24 abuts on the identifier 24, is pressed thereby and becomes an ON state. Moreover, a microswitch 23 which enters a deep identifier 24 is fitted into the identifier 24 and becomes an OFF state. Therefore, it is possible to determine the tape type by detecting the state of the microswitch 23.

The printing tape T is let out from the tape reel 17 and the ink ribbon R is let out from the ribbon reel 19. The ink ribbon R is rolled up by the ribbon take-up reel 22 after being conveyed while overlapping with the printing tape T. Specifically, the platen roller 21 and the ribbon take-up reel 22 are rotated in a manner synchronized with each other. Thus, the printing tape T and the ink ribbon R are simultaneously fed and the thermal head 12 is driven in a manner synchronized therewith. Consequently, printing is performed.

Figure 2B:
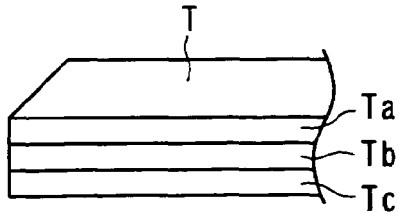
Figure 4A:
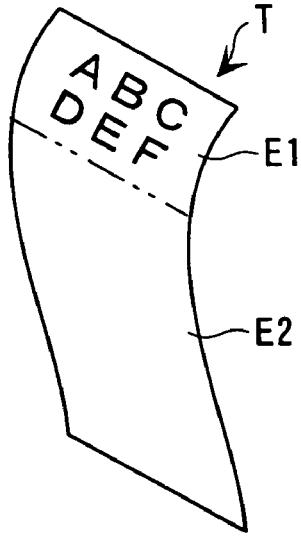
FIGS. 4A to 4C are explanatory views showing procedures of attaching a printing tape to an object.
Figure 4B:
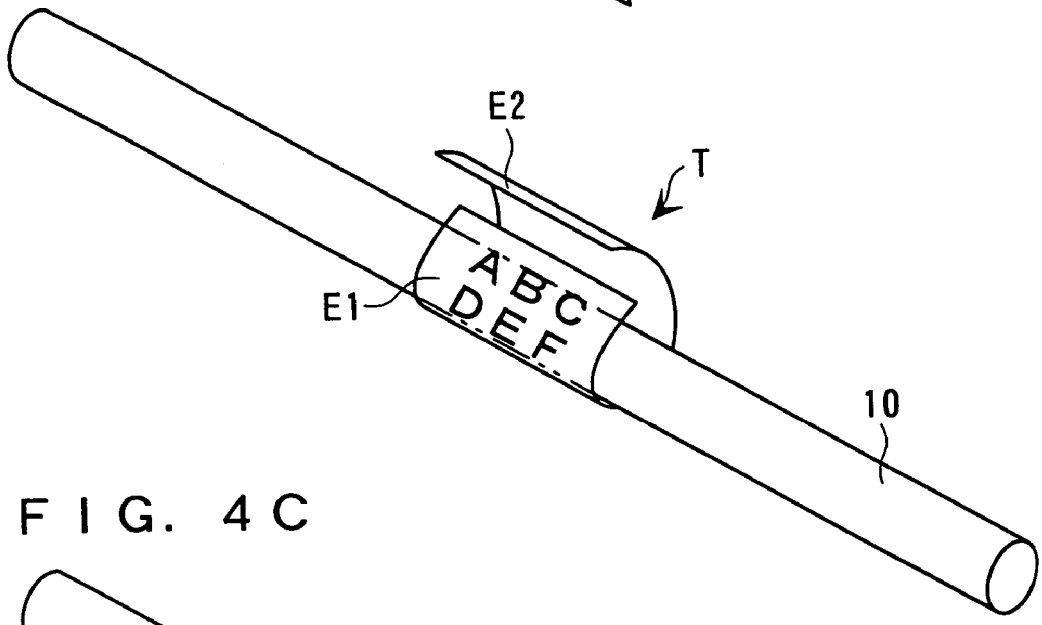
Figure 4C:
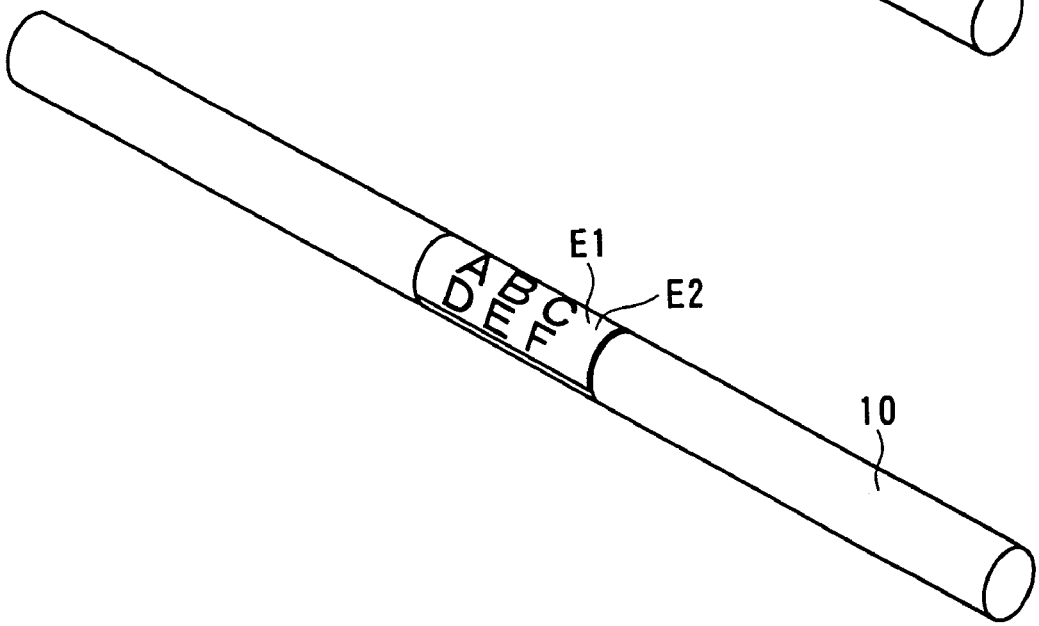

As shown in FIG. 2B, the printing tape T has a structure in which a base material layer Ta which will become a print surface and has translucency (transparent or semi-transparent), an adhesive layer Tb having translucency and a release paper layer Tc having non-translucency are laminated. The printing tape T is used in such a manner that, after creation of a label, the release paper layer Tc is released and the base material layer Ta (and the adhesive layer Tb) is attached to the object. I it is preferable that the release paper layer Tc is colored in white so that a color of the base material layer Ta having translucency can be easily confirmed. Moreover, as shown in FIG. 4A, the printing tape T is divided into a print region E1 where printing is performed and a non-print region E2 where printing is forbidden. When the tape is attached around an object 10 from an edge portion of the tape by using the print region E1 as a base point (see FIG. 4B), the print region E1 is set so as to be overlaid with the non-print region E2 that is a non-print part. To be more specific, the print region E1 is set in such a manner that an area ratio of the print region E1 to the non-print region E2 is 1:3 to 1:4 (printing is performed only in the print region E1 which is a region 1/5 to 1/4 of a printed tape part). When the tape is attached to the object 10, the print region E1 can be surely overlaid with the non-print region E2 (see FIG. 4C)

Figure 3:
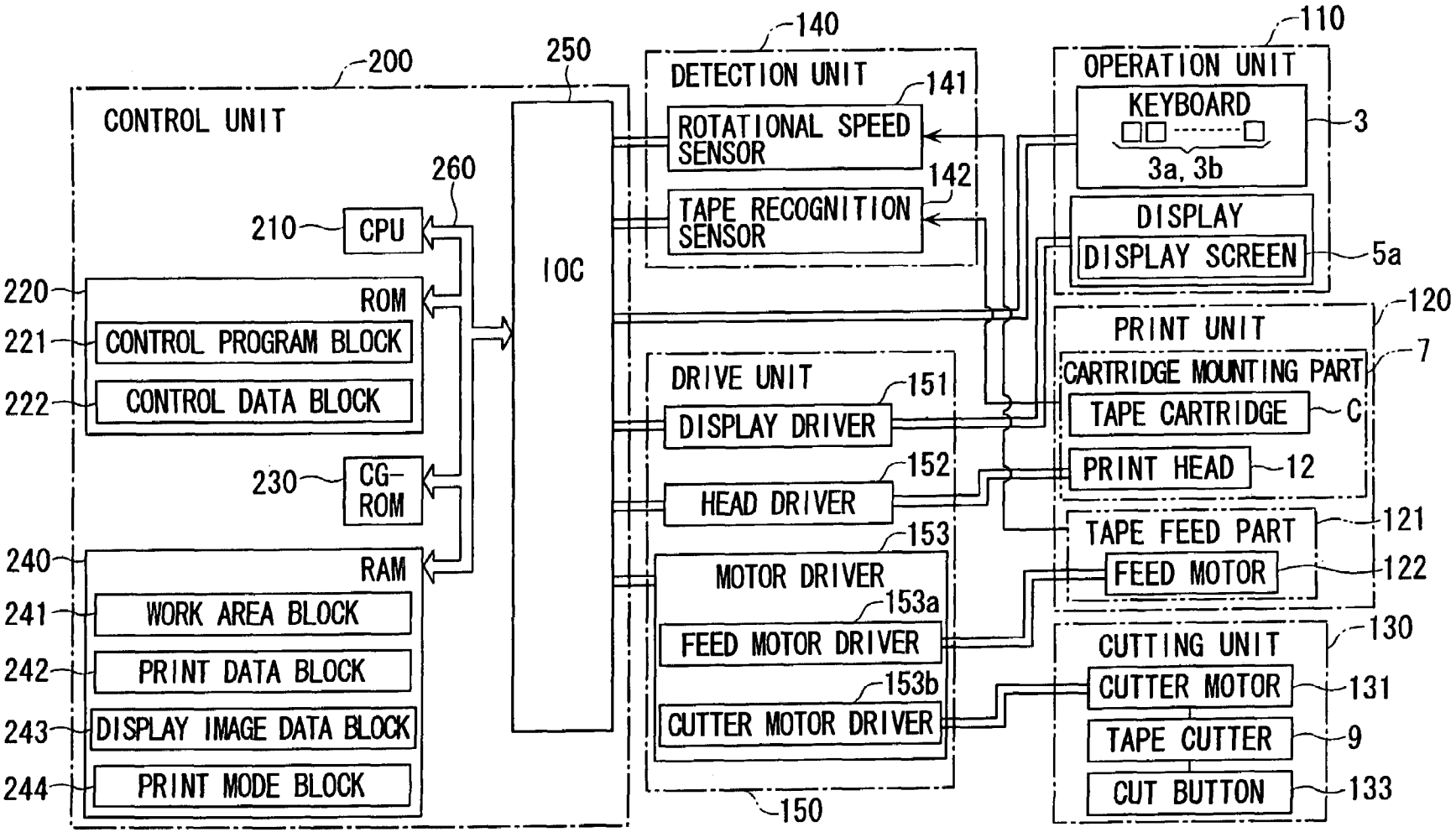
FIG. 3 is a control block diagram showing a control arrangement of the tape printing apparatus.

Here, a control arrangement of the tape printing apparatus 1 will be described with reference to a control block diagram shown in FIG. 3. The tape printing apparatus 1 includes: an operation unit 110 which has the keyboard 3 and the display screen 5*a* and serves as a user interface such as input of characters and display of various information by a user; a print unit 120 which has the cartridge mounting part 7 in which the tape cartridge C and the print head (thermal head) 12 are disposed and a tape feed part 121 for conveying the tape T and the ink ribbon R by using a feed motor 122 and which performs printing on the tape T based on generated print data; a cutting unit 130 which has the tape cutter 9, a cutter motor 131 for driving the tape cutter 9 and a cut button 133 for instructing tape cutting and which cuts off the printed tape T in a predetermined length; a detection unit 140 which has a rotational speed sensor 141 for detecting a rotational speed of the feed motor 122 and a tape recognition sensor 142 including the microswitches 23 for detecting the type of the printing tape T (the tape cartridge C) and which performs various detections; a drive unit 150 which has a display driver 151, a head driver 152 and a motor driver 153 (a feed motor driver 153*a* and a cutter motor driver 153*b*) and which drives respective parts; and a control unit 200 which is connected to the respective parts and controls the entire tape printing apparatus 1.

The control unit 200 includes a central processing unit (CPU) 210, a read only memory (ROM) 220, a character generator ROM (CG-ROM) 230, a random access memory RAM 240 and an input output controller (hereinafter referred to as "IOC") 250, which are connected to each other by an internal bus 260. The ROM 220 includes: a control program block 221 for storing control programs processed by the CPU 210; and a control data block 222 for storing control data including data on setting conditions (the type of the tape cartridge C and the like) for setting a print mode, and the like. Moreover, the CG-ROM 230 stores font data such as characters and, upon receiving code data specifying characters and the like, outputs font data corresponding to the code data.

The RAM 240 includes: various work area blocks 241 used as flags and the like; a print data block 242 for storing generated print data; a display image data block 243 for storing image data to be displayed on the display screen 5*a*; and a print mode block 244 for storing a print mode set by pressing the print mode key. The RAM 240 is used as a work area for control processing. Moreover, the RAM 240 is backed up all the time so as to retain stored data even if the power is turned off.

In the IOC 250, logic circuits for supplementing functions of the CPU 210 and handling interface signals between various peripheral circuits are built-in, the logic circuits including gate arrays and custom large scale integrated circuits (LSIs). Thus, the IOC 250 takes input data from the keyboard 3 and control data, as they are or after processing the data, into the internal bus 260. At the same time, the IOC 250 operates simultaneously with the CPU 210 and outputs data and control signals, which are outputted to the internal bus 260 from the CPU 210, to the drive unit 150, the data and signals being outputted as they are or after being processed.

Accordingly, with the above-described arrangement, the CPU 210 inputs various signals and data from the respective parts within the tape printing apparatus 1 through the IOC 250 in accordance with the control programs in the ROM 220. Thereafter, the CPU 210 processes the font data from the CG-ROM 230 and the various data in the RAM 240 and outputs the various signals and data to the respective parts within the tape printing apparatus 1 through the IOC 250. Thus, the CPU 210 performs setting of the print mode (the normal mode or the cylinder label mode), control of print processing in accordance with the print mode, and the like.

Figure 5:
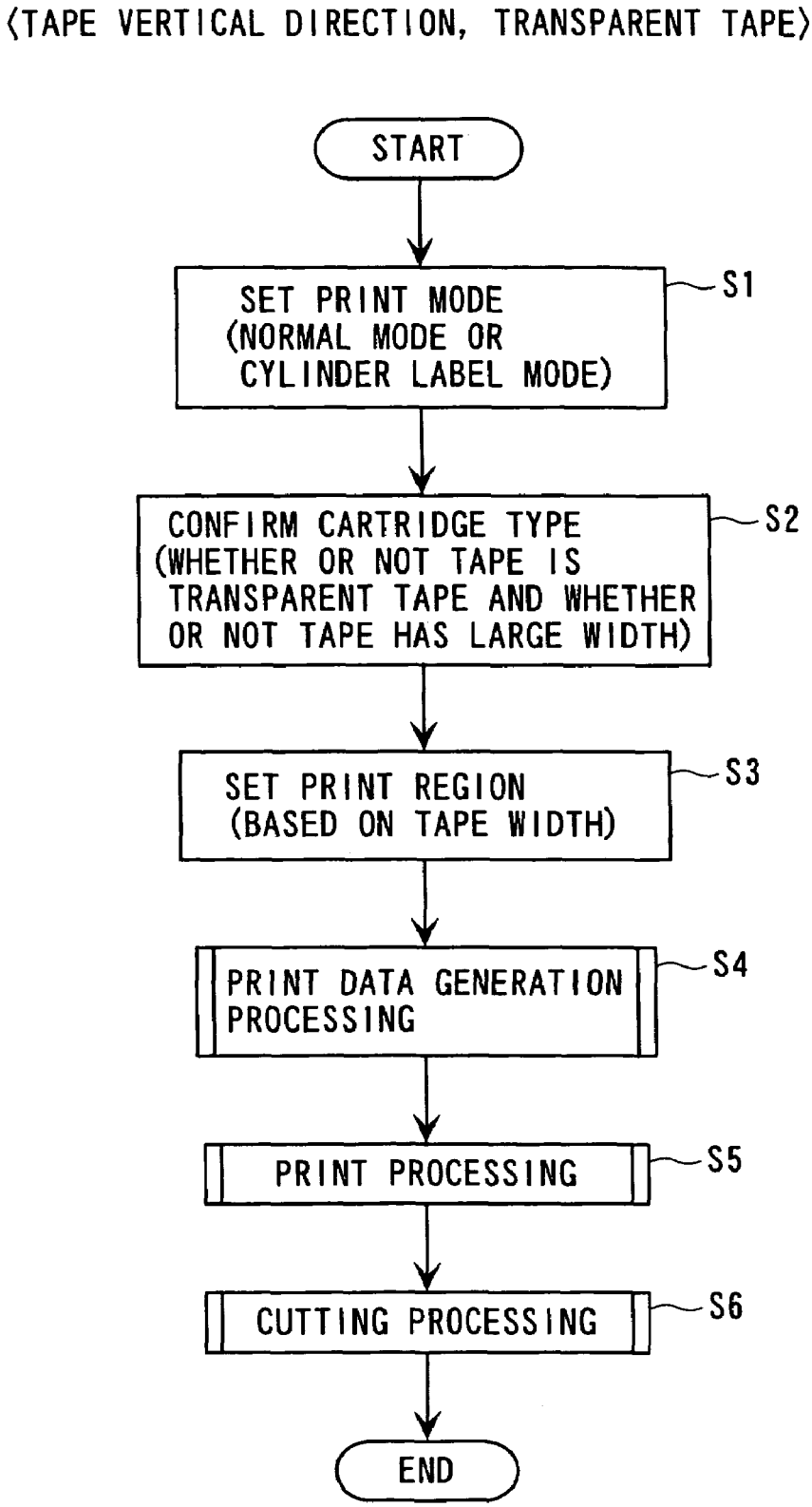
FIG. 5 is a flowchart schematically showing a method for creating a label according to a first embodiment of the present invention.
Figure 11A:
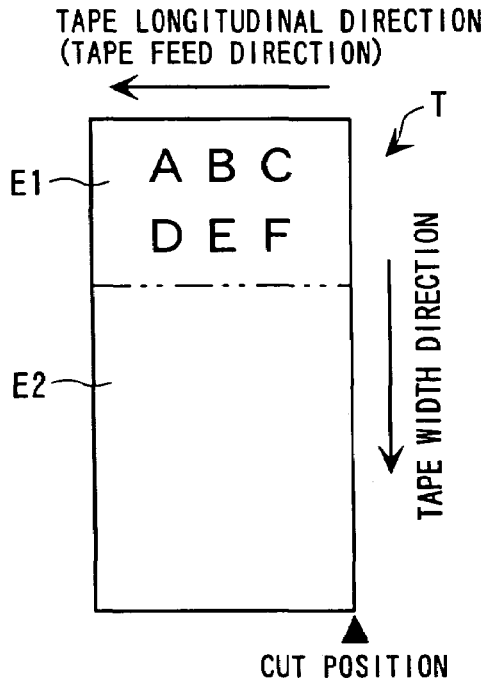
FIGS. 11A and 11B are views showing printed tapes according to the first and second embodiments of the present invention.
Figure 11B:
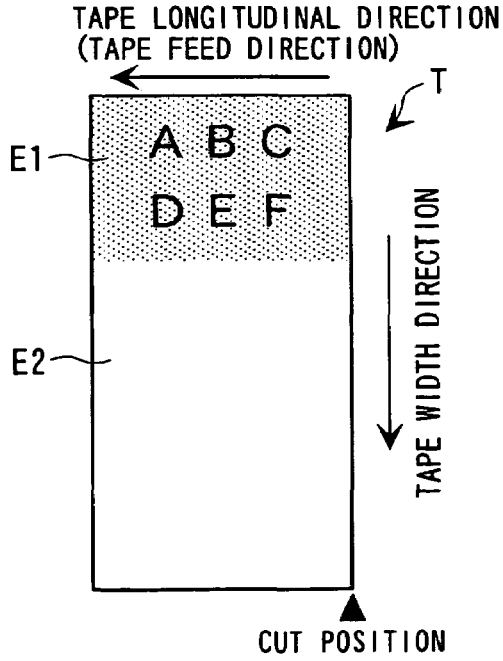

Next, with reference to a simple flowchart shown in FIG. 5, a description will be made about a method for creating a label to be attached to a linear or bar-shaped object 10 by using the tape printing apparatus 1. Here, as described above, the transparent or semi-transparent printing tape T having transparency is used as a medium to be printed and the print region E1 and the non-print region E2 are laid out parallel to a longitudinal direction of the printing tape T, i.e., in a width direction of the tape (see FIG. 11A). In case where the print region E1 and the non-print region E2 are laid out parallel to the longitudinal direction of the printing tape T, the case will be hereinafter referred to as a "case of a tape longitudinal direction" assuming that the tape is used in its longitudinal direction.

First, the power of the tape printing apparatus 1 is turned ON by the user and various initializations are performed. Thereafter, when the print mode is set to a print mode for creating a label to be attached to a linear or bar-shaped object (hereinafter referred to as a "cylinder label mode") by pressing the print mode key (S1), a cartridge type is detected by the microswitches 23 (S2). Here, it is detected whether or not the printing tape T is a tape having translucency (hereinafter referred to as a "transparent tape") as well as whether or not the printing tape is a tape having a large width. When the printing tape is not the transparent tape (but a colored tape) or when the tape width is less than 24 mm, the printing tape is determined to be inappropriate as the cylinder label. Subsequently, an error indication and a reason for the error or an instruction ("this cartridge is not one corresponding to cylinder label mode", "change to transparent tape") are displayed on the display screen 5*a*.

Next, in accordance with a width of a tape housed in the detected tape cartridge C, the print region E1 is set in an upper end portion (or a lower end portion) of the tape (S3). For example, when the tape width is 24 mm, a length of the print region E1 in a tape width direction is set to about 4.8 to 6.0 mm. The length of the print region E1 in the tape width direction is primarily determined in accordance with the tape width and the length of the print region E1 and the tape width are stored as a correlated table in the ROM 220 and the like.

Next, print data is generated by inputting characters from the keyboard 3 by the user (S4). Here, there is no limitation on the number of characters in one line (in the case of FIG. 4A, "ABC . . . "). However, in accordance with the set print region E1 (in accordance with the tape width), the number of lines is limited. For example, when the tape width is 24 mm, the number of lines is limited to three or less. When more than three lines are inputted (a line feed key is pressed), an error display is performed together with annunciation by an electronic sound. In accordance with the inputted number of lines, processing such as disposing the respective lines in the tape width direction with an equal space therebetween and reducing a character size is performed. However, as to the processing described above, a technology generally used in a character input device or the like is applicable. Thus, description thereof will be omitted herein.

Next, printing is performed in the set print region E1 based on the generated print data (S5). Thereafter, a tape rear end portion is cut off in the tape width direction so as to have a length corresponding to the print data (S6). Thus, a label created by using the method described above is one as shown in FIG. 11A and is attached around the linear or bar-shaped object 10 by using the print region E1 as a base point. Here, the print region E1 is overlaid (laminated) with the non-print region E2. In the drawings (FIGS. 11 to 16), for simplification, the area ratio of the print region E1 to the non-print region E2 is not 1:3 to 1:4. Thus, the labels shown in the drawings are slightly different from those actually created.

As described above, according to this embodiment, when the label is attached around the object 10 from the edge portion in the width direction of the printed tape part, the print region E1 is set to be overlaid with the non-print region E2 that is the non-print part. Thus, the abrasion resistance and the rubfastness of the label (the print region E1) can be improved. Moreover, since the printing tape T that is the medium to be printed has translucency, visibility of the print region E1 is not diminished.

In the above-described example, it is assumed that the length of the print region E1 in the tape width direction is primarily determined in accordance with the tape width. However, the length thereof may be set to a certain length such as 5 mm or 10 mm, for example, without depending on the tape width. With the arrangement described above, it is not required to include a table in which the tape width and the length of the print region E1 in the tape width direction are correlated with each other.

Moreover, in the above-described example, it is assumed that the print mode is set by pressing the print mode key. However, the print mode may be set by displaying two options ("cylinder label mode" and "normal mode") on the display screen 5*a* and selecting any one of the options by using the cursor keys and the like. With the arrangement described above, it is not required to include the print mode key and thus the number of keys disposed in the keyboard 3 can be reduced.

Figure 6:
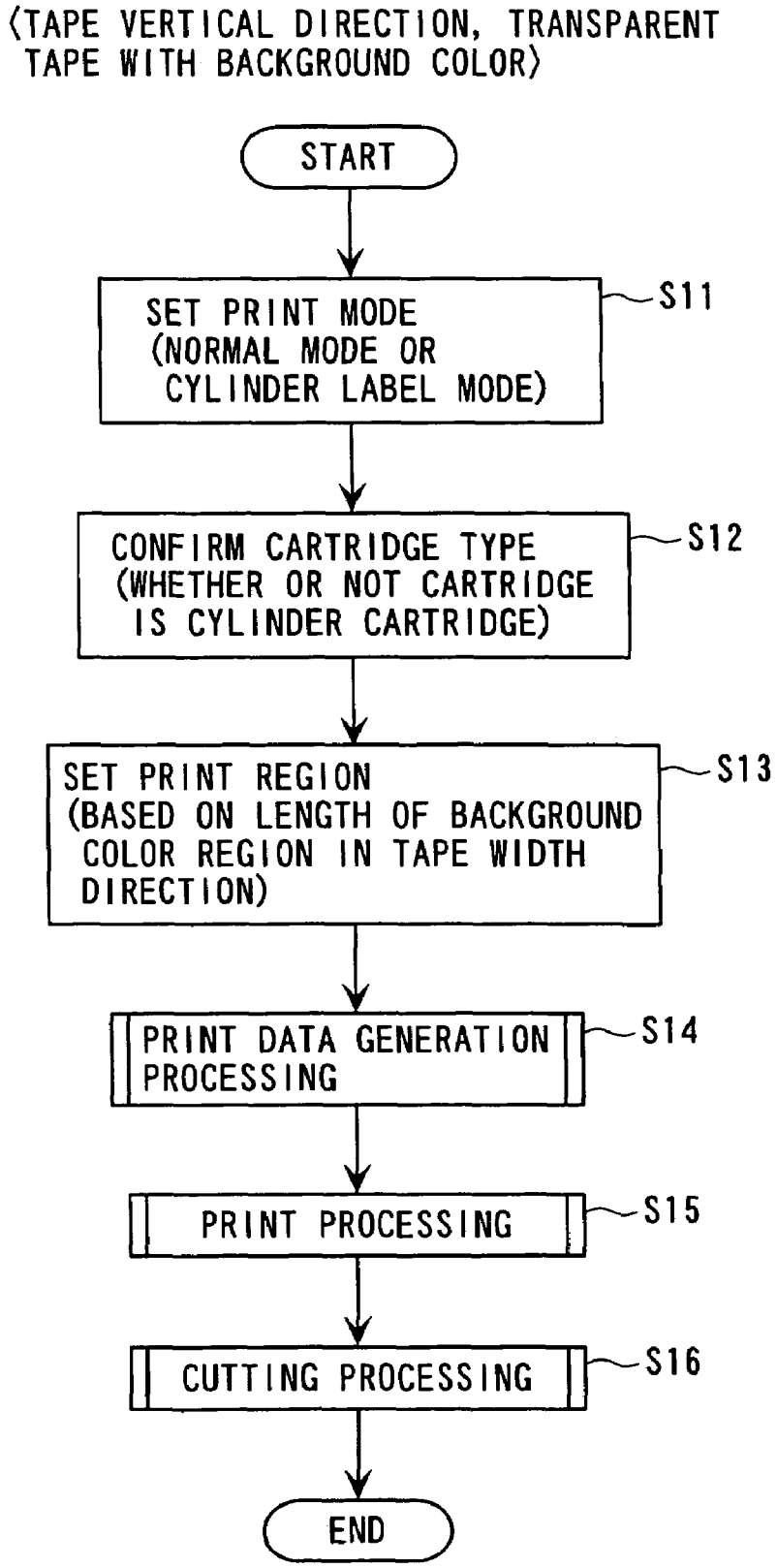
FIG. 6 is a flowchart schematically showing a method for creating a label according to a second embodiment of the present invention.
Figure 20A:
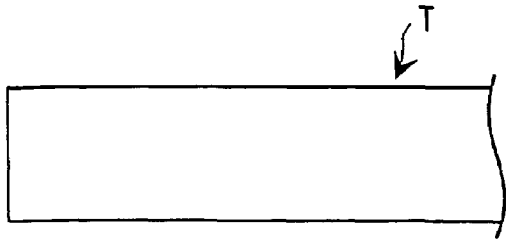
FIGS. 20A to 20G are views showing examples of a printing tape used in the present invention.

Next, a second embodiment of the present invention will be described. In the first embodiment described above, the printing tape T which is entirely transparent is used as the medium to be printed (see FIG. 20A). Meanwhile, in the second embodiment, used is a printing tape T which is divided into a print region E1 which has a background color and where printing is performed and a non-print region E2 which has translucency and where printing is forbidden (see FIG. 20B). Moreover, in the printing tape T used in this embodiment, the print region E1 and the non-print region E2 are previously set in such a manner that the print region E1 is overlaid with the non-print region E2 when the tape is attached to the object 10. Thus, with the arrangement described above, the tape printing apparatus 1 according to this embodiment can create a label in which visibility of printed characters and images is not diminished by a color of the object 10 to be a base. Moreover, when this label is attached to the object 10, the abrasion resistance and the rubfastness of the label (the print region E1) can be improved. Here, with a focus on a difference between the first and second embodiments, the second embodiment will be described below with reference to a flowchart shown in FIG. 6 and a printed tape shown in FIG. 11B.

Figure 20B:
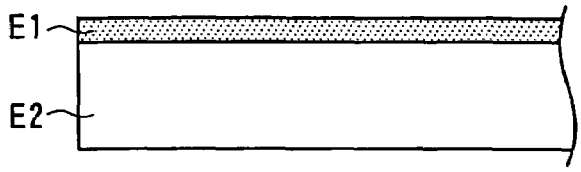

First, when the print mode key is pressed by the user to set the print mode to the cylinder label mode (S11), the cartridge type is detected by the microswitches 23 (S12). Here, it is detected whether or not the cartridge is a cylinder cartridge, in other words, it is detected whether or not the printing tape T previously divided into the print region E1 and the non-print region E2, as shown in FIG. 20B, is housed. When it is determined that the cartridge is not the cylinder cartridge, an error display is performed on the display screen 5*a*. Moreover, at the same time, here, a length of the print region E1 in a width direction of the housed printing tape T is also detected.

Next, in accordance with the length of the print region E1 (a background color region) in the width direction of the printing tape T housed in the detected tape cartridge C (cylinder cartridge), the print region E1 is set in an upper end portion (or a lower end portion) of the tape (S13).

Next, characters are inputted from the keyboard 3 by the user to generate print data (S14). Here, similar to the case of the first embodiment, there is no limitation on the number of characters in one line (in the case of FIG. 11B, "ABC . . . "). However, in accordance with the set print region E1, the number of lines is limited.

Next, printing is performed in the set print region E1 based on the generated print data (S15). Thereafter, a tape rear end portion is cut off in the tape width direction so as to have a length corresponding to the print data (S16). Thus, a label created by using the method described above is one as shown in FIG. 11B and is attached around the linear or bar-shaped object 10 by using the print region E1 as a base point. Here, the print region E1 is overlaid (laminated) with the non-print region E2.

As described above, according to this embodiment, printing is performed in the print region E1 having the background color. Thus, visibility of printed characters and images is not diminished by a color of the object to be a base. It is preferable that the background color in the print region E1 contrasts with a color of the ink ribbon R. With the arrangement described above, the visibility of the characters and images printed in the print region E1 can be further improved. Moreover, the respective regions are previously set in such a manner that the print region E1 is overlaid with the non-print region E2. Thus, when the label is attached to the object 10, the abrasion resistance and the rubfastness of the label (the print region E1) can be improved.

Next, a third embodiment of the present invention will be described. In the foregoing first and second embodiments, the printing tape T is used in the vertical direction (as seen in the figure, i.e., the print region E1 and the non-print region E2 are laid out parallel to the longitudinal direction of the printing tape T). In this embodiment, the printing tape T is used in a horizontal direction (as seen in the figure). With this arrangement, the length of the tape in the longitudinal direction can be arbitrarily set. Thus, it is possible to create a label which can also be attached to an object 10 having a large diameter.

Figure 7:
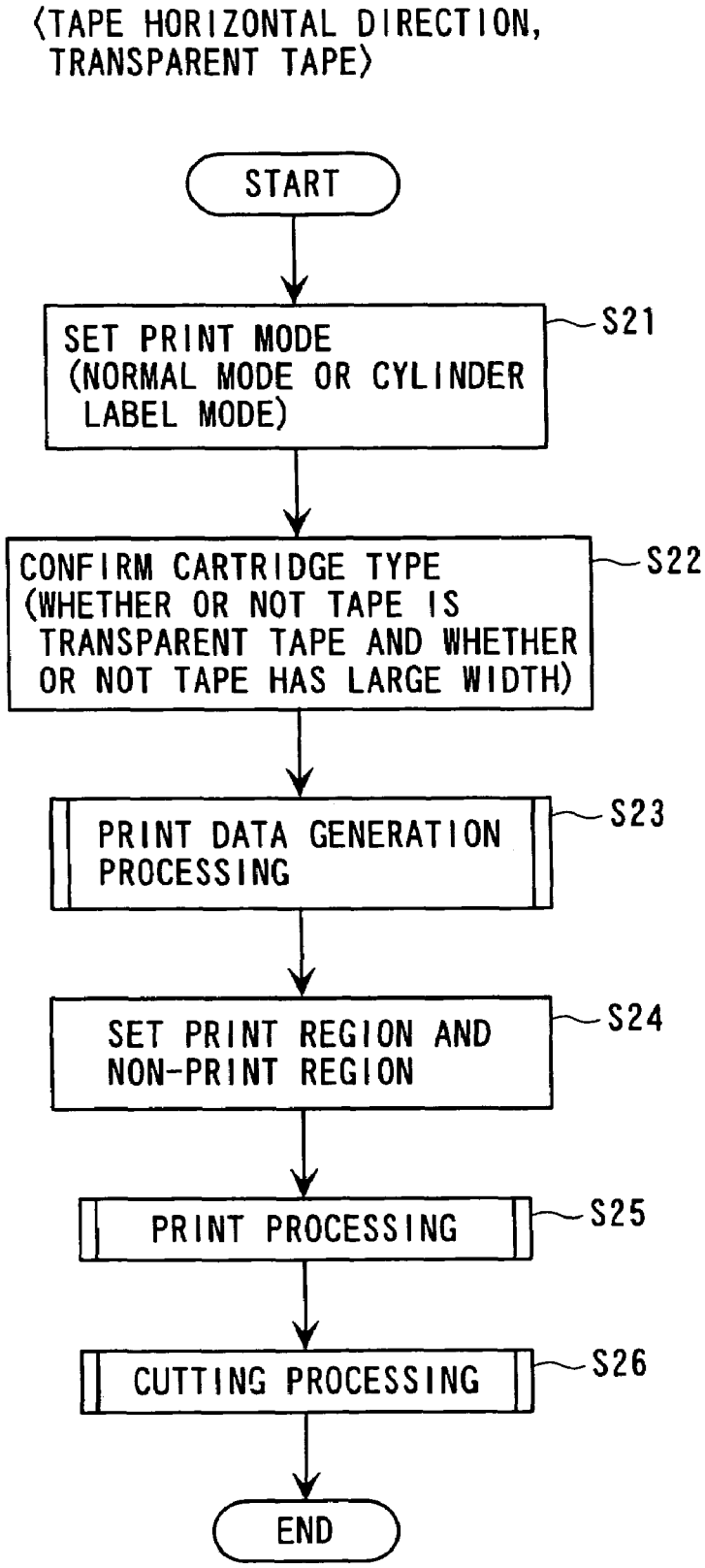
FIG. 7 is a flowchart schematically showing a method for creating a label according to a third embodiment of the present invention.

Moreover, in this embodiment, lengths of the print and non-print regions E1 and E2 in the longitudinal direction are set based on generated print data (the number of inputted characters). Therefore, with the arrangement described above, even if the number of characters to be printed is large, the print region E1 can be set so as to be surely overlaid with the non-print region E2. Here, with a focus on a difference between the third embodiment and the above-described embodiments, the third embodiment will be described below with reference to a flowchart shown in FIG. 7 and a printed tape shown in FIG. 12A. The printing tape T used in this embodiment is the same as that of the first embodiment, which is entirely translucent (see FIG. 20A).

First, when the print mode key is pressed by the user to set the print mode to the cylinder label mode (S21), the cartridge type is detected by the microswitches 23. (S22). Here, it is detected whether or not the printing tape is a transparent tape and whether or not the printing tape has a large width. When the printing tape T is not the transparent tape or when the tape width is less than 18 mm, the number of characters per line is limited. Thus, it is determined that the printing tape T is inappropriate as the cylinder label. Accordingly, an error display is performed on the display screen 5*a*.

Next, characters are inputted from the keyboard 3 by the user to generate print data (S23). Here, in accordance with the tape width, the number of characters which can be inputted per line is limited. For example, when the tape width is 18 mm, the number of characters which can be inputted per line is seven. Here, there is no limitation on the number of lines. However, the number of lines may be limited in accordance with the tape width or to ten lines or less in a single uniform way.

Next, in accordance with the generated print data (in accordance with the number of lines of inputted characters), the print region E1 and the non-print region E2 are set (S24). In this case, the respective regions are set in such a manner that the area ratio of the print region E1 to the non-print region E2 is 1:3 to 1:4. It is also possible that only the print region E1 is set in accordance with the generated print data and a length of the non-print region E2 in a tape longitudinal direction is set to a certain length. Moreover, on the contrary, it is also possible that only the non-print region E2 is set in accordance with the generated print data and a length of the print region E1 in the tape longitudinal direction is set to a certain length.

Figure 12A:
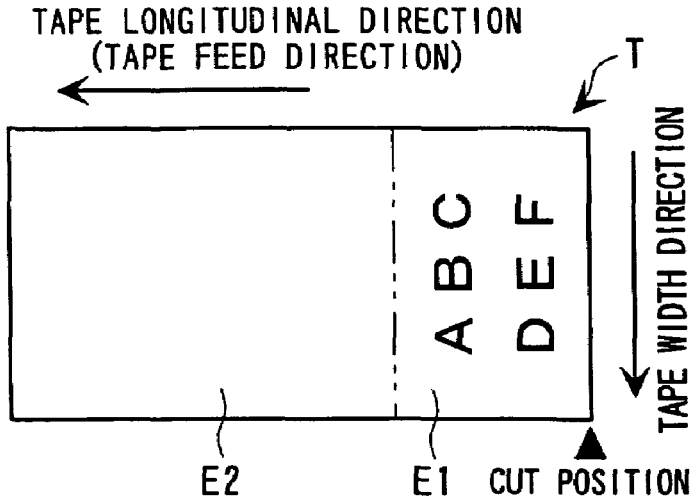
FIGS. 12A to 12C are views showing printed tapes according to the third and fourth embodiments of the present invention.
Figure 12B:
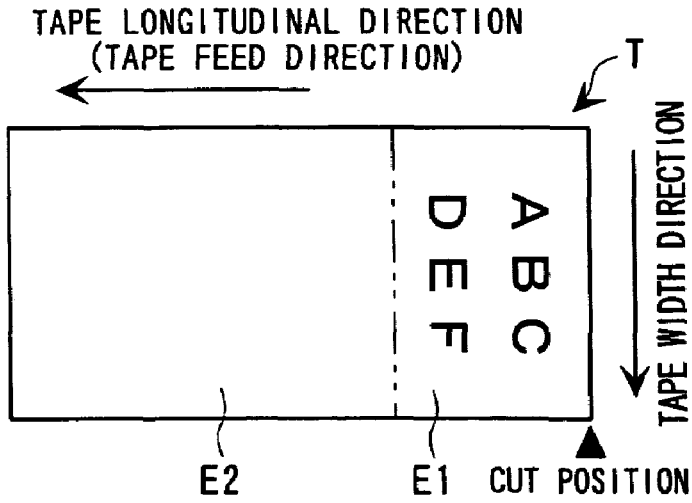
Figure 21A:
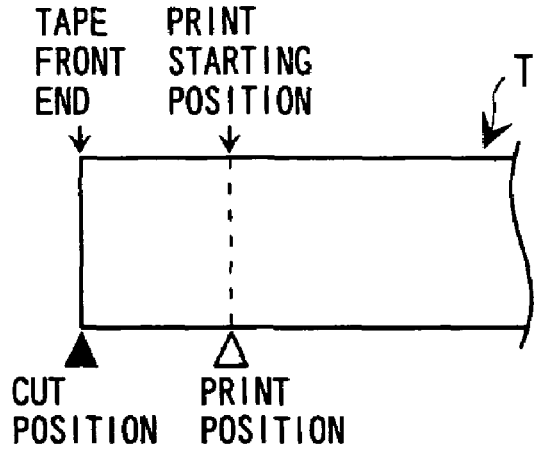
FIGS. 21A to 21C are explanatory views showing a case where a print region is disposed on a downstream side of a non-print region.
Figure 21B:
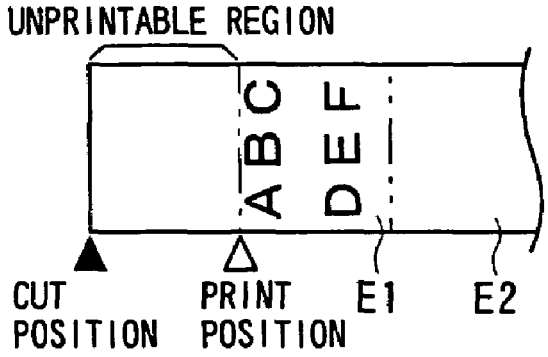
Figure 21C:
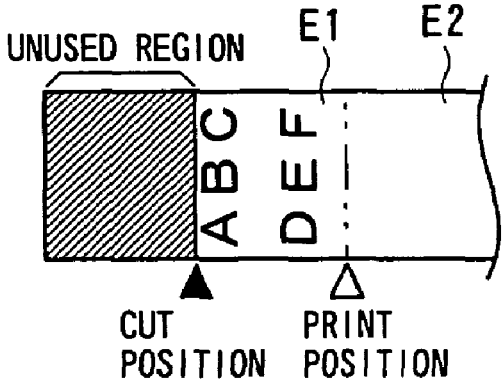

In addition, in this case, the print region E1 and the non-print region E2 are disposed in such a manner that the print region E1 is disposed on an upstream side along a tape feed direction (see FIG. 12A). With this arrangement, printing can be performed up to the vicinity of a tape end (a tape rear end) without wasting the printing tape T. Here, the disposition of the print and non-print regions E1 and E2 will be described in detail with reference to FIGS. 21A to 21C. When the print region E1 is disposed on a downstream side of the non-print region E2 (i.e., at a tape front end side), a print position (a print head position) becomes a print starting position as shown in FIG. 21A. Thus, as shown in FIG. 21B, printing cannot be performed for a length between the print position and a cutting position (a cut position) from the tape front end. Therefore, in a label created in this state, an unprintable region is generated for the length between the print position and the cutting position. However, the label does not look good as long as such unnecessary region remains. Thus, as shown in FIG. 21C, it is also possible that, when the tape is fed until the front end of the print region E1 reaches the cutting position, the printing tape T is cut off. However, in this case, a tape unused region is generated and thus the tape is wasted. Specifically, a problem arises in any of the methods shown in FIGS. 21A to 21C. However, according to the present invention, the print region E1 is disposed on the upstream side along the tape feed direction. Thus, printing can be performed up to the vicinity of the tape end (the tape rear end) without wasting the printing tape T.

Next, printing is performed in the set print region E1 based on the generated print data (S25). Thereafter, a tape rear end portion is cut off in the tape width direction so as to have a length corresponding to the print data (S26). Thus, a label created by using the method described above is one as shown in FIG. 12A and is attached around the linear or bar-shaped object 10 by using the print region E1 as a base point. Here, the print region E1 is overlaid (laminated) with the non-print region E2.

As described above, according to this embodiment, the length of the printing tape T in the longitudinal direction can be arbitrarily set by dividing the tape parallel to the width direction thereof. Thus, it is possible to create a label which can also be attached to the object 10 having a large diameter. Moreover, the length of the print region E1 and/or the length of the non-print region E2 in the longitudinal direction are set based on the generated print data. Thus, even if the number of lines to be printed is large, the print region E1 can be set so as to be surely overlaid with the non-print region E2. Furthermore, the print region E1 is disposed on the upstream side of the non-print region E2 along the feed direction of the printing tape T. Thus, printing can be performed up to the vicinity of the tape end (the tape rear end) without wasting the printing tape T.

In this embodiment, a direction of characters is set in such a manner that heads of the characters face the tape front end (see FIG. 12A). However, the direction of characters may be set as selectable such that the heads of the characters are reversely set to face the tape rear end (see FIG. 12B). For example, when the heads of characters are set to face the tape front end, in attaching the tape to the object 10 while using the print region E1 as a base point, the tape can be attached around the object 10 from its upper side by using the character direction as a forward direction. Moreover, when the heads of characters are set to face the tape rear end, in attaching the tape to the object 10 while using the print region E1 as a base point, the tape can be attached around the object 10 from its lower side by using the character direction as the forward direction. Specifically, with the arrangement described above, the character direction can be selected according to the user's preference. In this case, selection may be made not for the character direction but for the direction to go around the object (the upper side or the lower side). With this arrangement, there are options provided for the method for going around the object by the printing tape T when the user actually performs an attachment operation. Thus, the user can easily select the option he/she likes.

Moreover, in this embodiment, the print region E1 is disposed on the upstream side of the non-print region E2 along the feed direction of the printing tape T (see FIG. 12A). However, the print region E1 may be disposed on the downstream side of the non-print region E2 (see FIG. 12C). With this arrangement, the tape can be easily attached and the character direction can be fixed t6 one direction only. Thus, control for reversing the character direction and an amount of data required for the control can be reduced.

Moreover, in this embodiment, the length of the print region E1 and/or the length of the non-print region E2 are set based on the generated print data. However, the respective regions may be disposed in previously set regions without depending on the print data. With this arrangement, processing of setting the print region E1 and the non-print region E2 can be omitted and processing of creating a cylinder label can be simplified.

Figure 8:
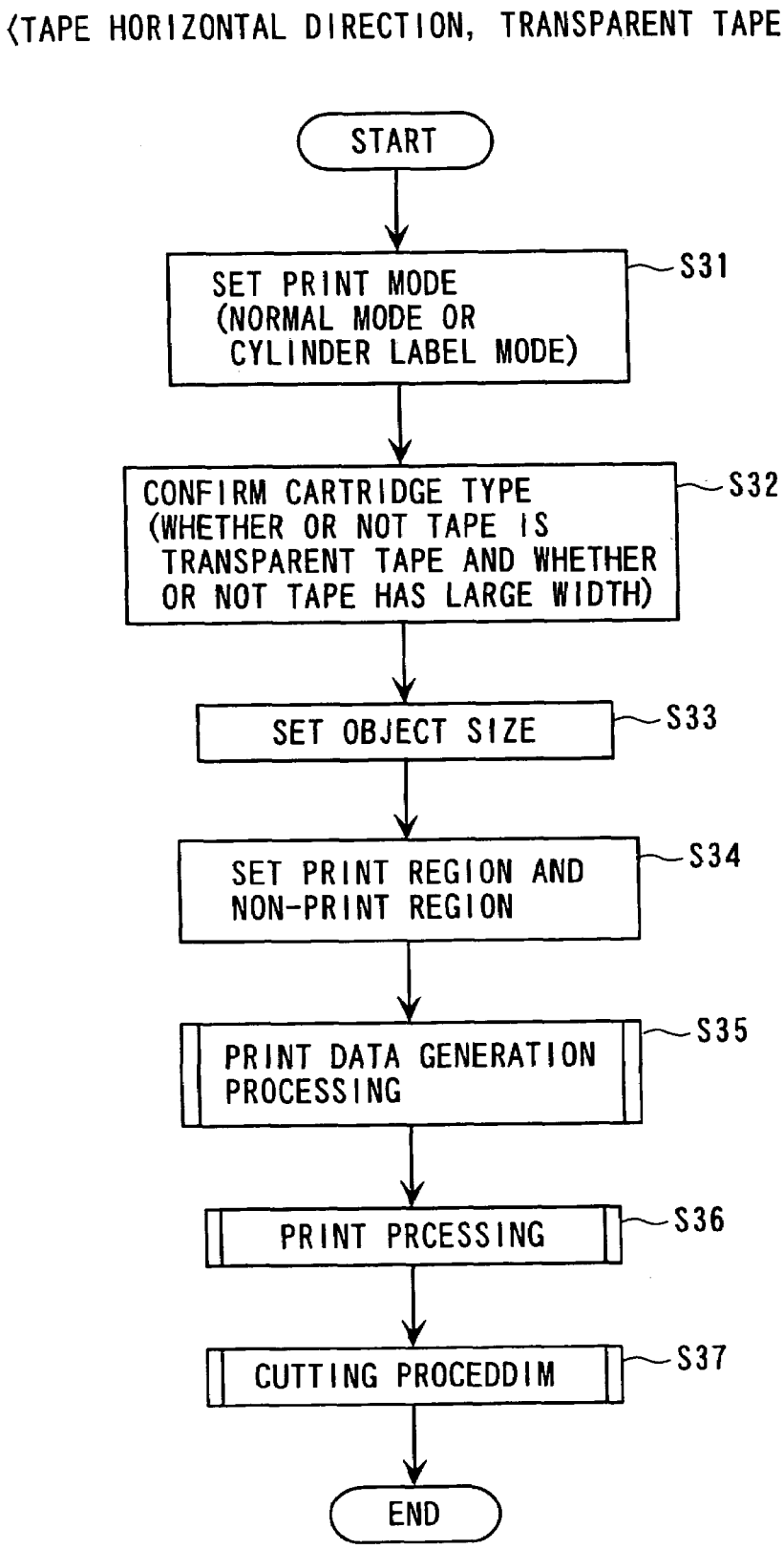
FIG. 8 is a flowchart schematically showing a method for creating a label according to a fourth embodiment of the present invention.

Next, a fourth embodiment of the present invention will be described. In the foregoing third embodiment, the length of the print region E1 and/or the length of the non-print region E2 in the longitudinal direction are set based on the generated print data (the number of inputted lines). Meanwhile, in this embodiment, the user inputs an object size such as a diameter of the object 10 and a length of circumference thereof. Thereafter, based on this object size, the length of the print region E1 and/or the length of the non-print region E2 in the longitudinal direction are set. Accordingly, with this arrangement, even if the diameter of the object 10 is large, the print region E1 can be set to be surely overlaid with the non-print region E2. Moreover, similar to the third embodiment, since the printing tape T is used in the horizontal direction, the length of the tape in the longitudinal direction can be arbitrarily set. Thus, it is possible to create a label which can be attached also to the object 10 having a large diameter. Here, with a focus on a difference between the fourth embodiment and the above-described embodiments, the fourth embodiment will be described below with reference to a flowchart shown in FIG. 8. The aspect of the printing tape T to be created is the same as that of the third embodiment (FIG. 12A).

First, when the print mode key is pressed by the user to set the print mode to the cylinder label mode (S31), the cartridge type is detected by the microswitches 23 (S32). Here, it is detected whether or not the printing tape is a transparent tape and whether or not the printing tape has a large width. When the printing tape T is not the transparent tape or when the tape width is less than 18 mm, the number of characters per line is limited. Thus, it is determined that the printing tape T is inappropriate as the cylinder label. Accordingly, an error display is performed on the display screen 5*a*.

Next, the size (the diameter or the length of circumference) of the object 10 is inputted by the user to set the object size (S33). Here, a plurality of options (for example, the length of diameter 2 mm, 3 mm, 5 mm and the like) are displayed on the display screen 5*a* and the user selects one of the options. Thus, the object size is set. The object size may be set by inputting numerical values directly from the keyboard 3.

Next, the print region E1 and the non-print region E2 are set in accordance with the inputted object size (S34). In this case, the area ratio of the print region E1 to the non-print region E2 is set to be 1:3 to 1:4. Moreover, it is preferable that the print region E1 is disposed on the upstream side of the non-print region E2 along the tape feed direction (see FIG. 12A). It is also possible that only the print region E1 is set in accordance with the inputted object size and the length of the non-print region E2 in the tape longitudinal direction is set to a certain length. Moreover, on the contrary, it is also possible that only the non-print region E2 is set in accordance with the inputted object size and the length of the print region E1 in the tape longitudinal direction is set to a certain length.

Next, characters are inputted from the keyboard 3 by the user to generate print data (S35). Thereafter, printing is performed in the set print region E1 based on the generated print data (S36) and a tape rear end portion is cut off in the tape width direction so as to have a length corresponding to the print data (S37). Thus, a label created by using the method described above is one as shown in FIG. 12A.

As described above, according to this embodiment, the length of the print region E1 and/or the length of the non-print region E2 in the longitudinal direction are set based on the inputted object size. Thus, even if the diameter of the object 10 is large, the print region E1 can be set to be surely overlaid with the non-print region E2.

Figure 9:
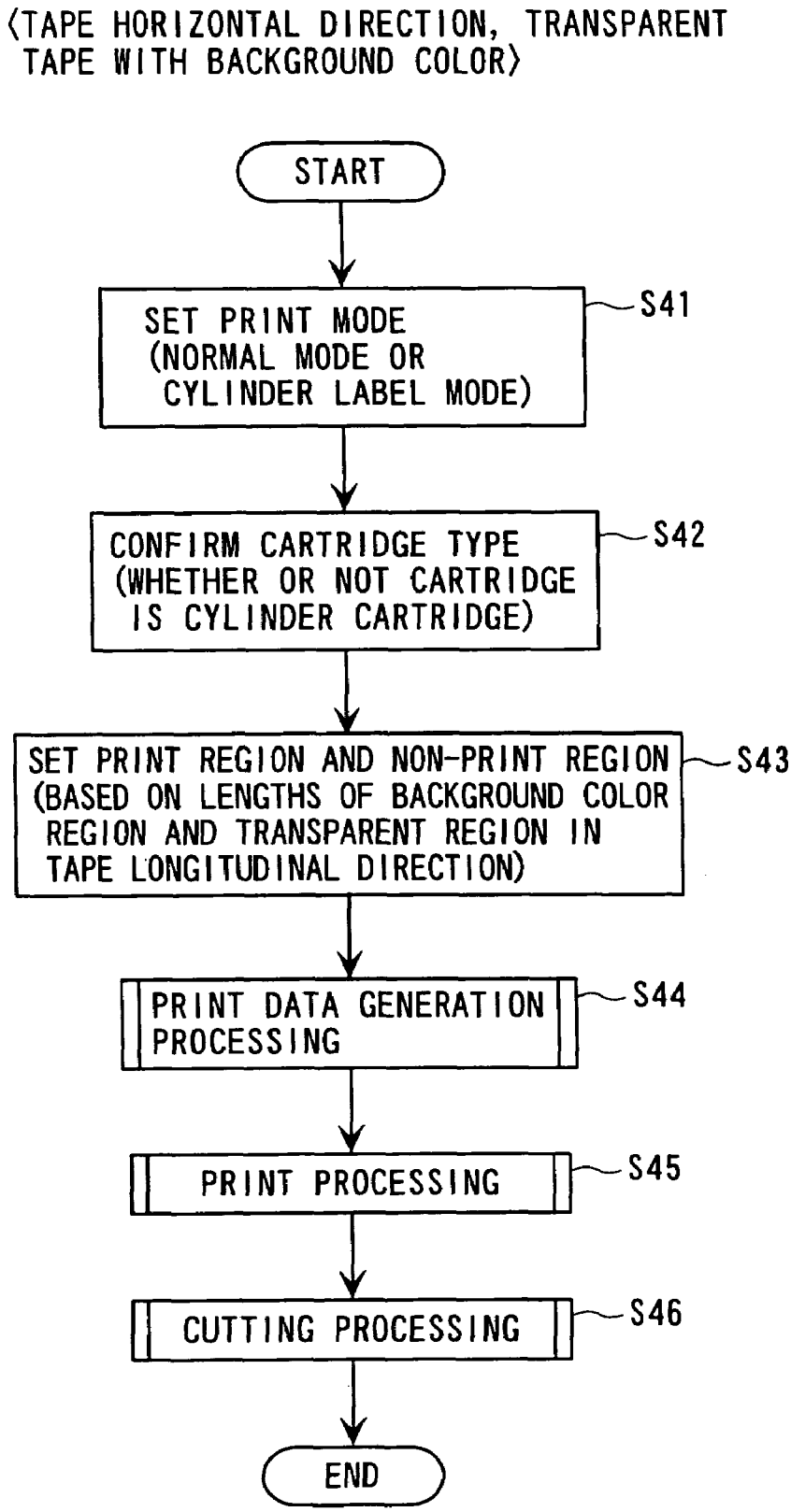
FIG. 9 is a flowchart schematically showing a method for creating a label according to a fifth embodiment of the present invention.
Figure 20C:
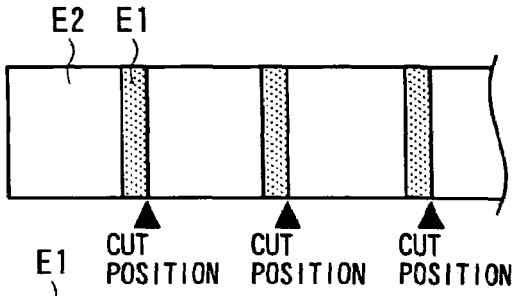
Figure 20D:
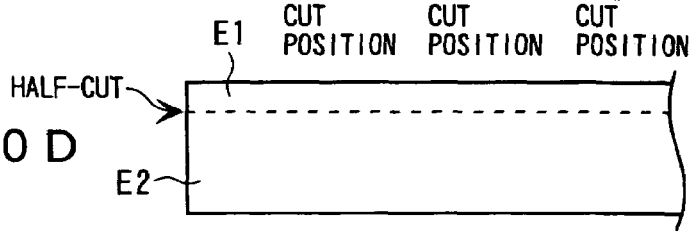
Figure 20E:
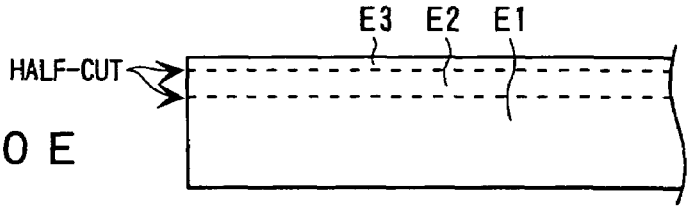
Figure 20F:
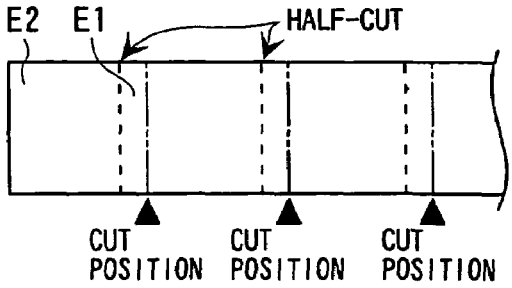
Figure 20G:
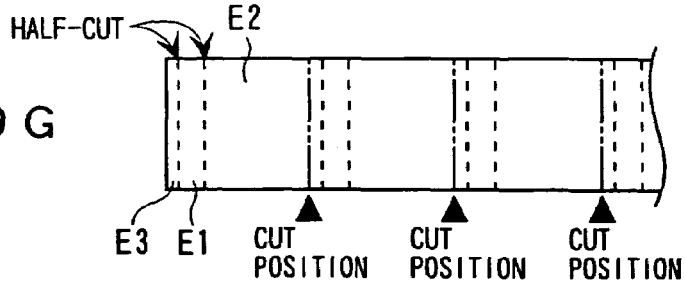

Next, a fifth embodiment of the present invention will be described. In this embodiment, used is a printing tape T divided into a print region E1 which has a background color and where printing is performed and a non-print region E2 which has translucency and where printing is forbidden, the printing tape being divided parallel to a tape width direction (see FIG. 20C). As shown in FIGS. 20C, 20F and 20G, cut positions are previously determined. Moreover, in the printing tape T used in this embodiment, the respective regions are previously set in such a manner that the print region E1 is overlaid with the non-print region E2 in attaching the tape to the object 10. Accordingly, with the arrangement described above, the tape printing apparatus according to this embodiment can create a label in which visibility of printed characters and images is not diminished by a color of the object 10 to be a base. Moreover, when this label is attached to the object 10, the abrasion resistance and the rubfastness of the label (the print region E1) can be improved. Here, with a focus on a difference between the fifth embodiment and the above-described embodiments, the fifth embodiment will be described below with reference to a flowchart shown in FIG. 9 and a printed tape shown in FIG. 13A.

First, when the print mode key is pressed by the user to set the print mode to the cylinder label mode (S41), the cartridge type is detected by the microswitches 23 (S42). Here, detection is made as to whether or not the cartridge is a cylinder cartridge, in other words, detection is made as to whether or not the printing tape T previously divided parallel to the tape width direction into the print region E1 and the non-print region E2, as shown in FIG. 20C, is housed. When it is determined that the cartridge is not the cylinder cartridge, an error display is performed on the display screen 5*a*. Moreover, at the same time, here, lengths of the print and non-print regions E1 and E2 in the longitudinal direction of the housed printing tape T are also detected. A background color region (the print region E1) and a transparent region (the non-print region E2) may be detected by using an optical sensor and the like. With the arrangement described above, the lengths of the respective regions in the tape longitudinal direction can be surely detected.

Next, in accordance with the lengths of the print region E1 (the background color region) and the non-print region E2 (the transparent region) in the longitudinal direction of the printing tape T housed in the detected tape cartridge C (the cylinder cartridge), the respective regions are set (S43). Subsequently, characters are inputted from the keyboard 3 by the user to generate print data (S44). Here, the number of lines is limited according to the length of the background color region in the longitudinal direction. In addition, the number of characters per line is limited according to the tape width.

Next, printing is performed in the set print region E1 based on the generated print data (S45). Thereafter, a tape rear end portion is cut off in the tape width direction so as to have a length corresponding to the print data (S46). Thus, a label created by using the method described above is one as shown in FIG. 13A.

As described above, according to this embodiment, printing is performed in the print region E1 having the background color. Thus, visibility of printed characters and images is not diminished by a color of the object 10 to be a base.

Figure 12C:
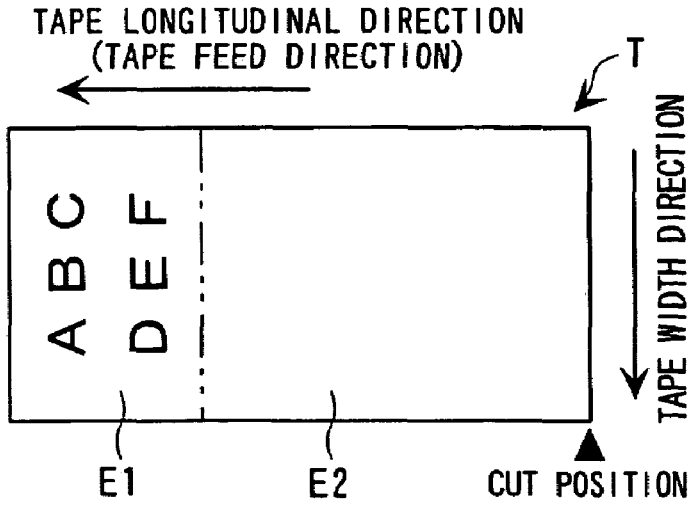

Also in this embodiment, it is possible to change the direction of characters (see FIG. 12B) and to change the disposition of the print region E1 and the non-print region E2 (see FIG. 12C).

Next, a sixth embodiment of the present invention will be described. In this embodiment, after printing, a boundary portion between the print region E1 and the non-print region E2 is half-cut in a tape longitudinal direction. "Half-cut" in this case means to cut only the release paper layer Tc (see FIG. 14A). Thus, the release paper layer only in the non-print region E2 is released (see FIG. 14B). Accordingly, when the tape is attached in such a manner that the print region E1 is overlaid with the non-print region E2, the release paper layer becomes a base in the print region E1. Consequently, even if the entire surface of the tape is translucent, visibility of printed characters and images is not diminished by a color of the object 10.

Figure 10:
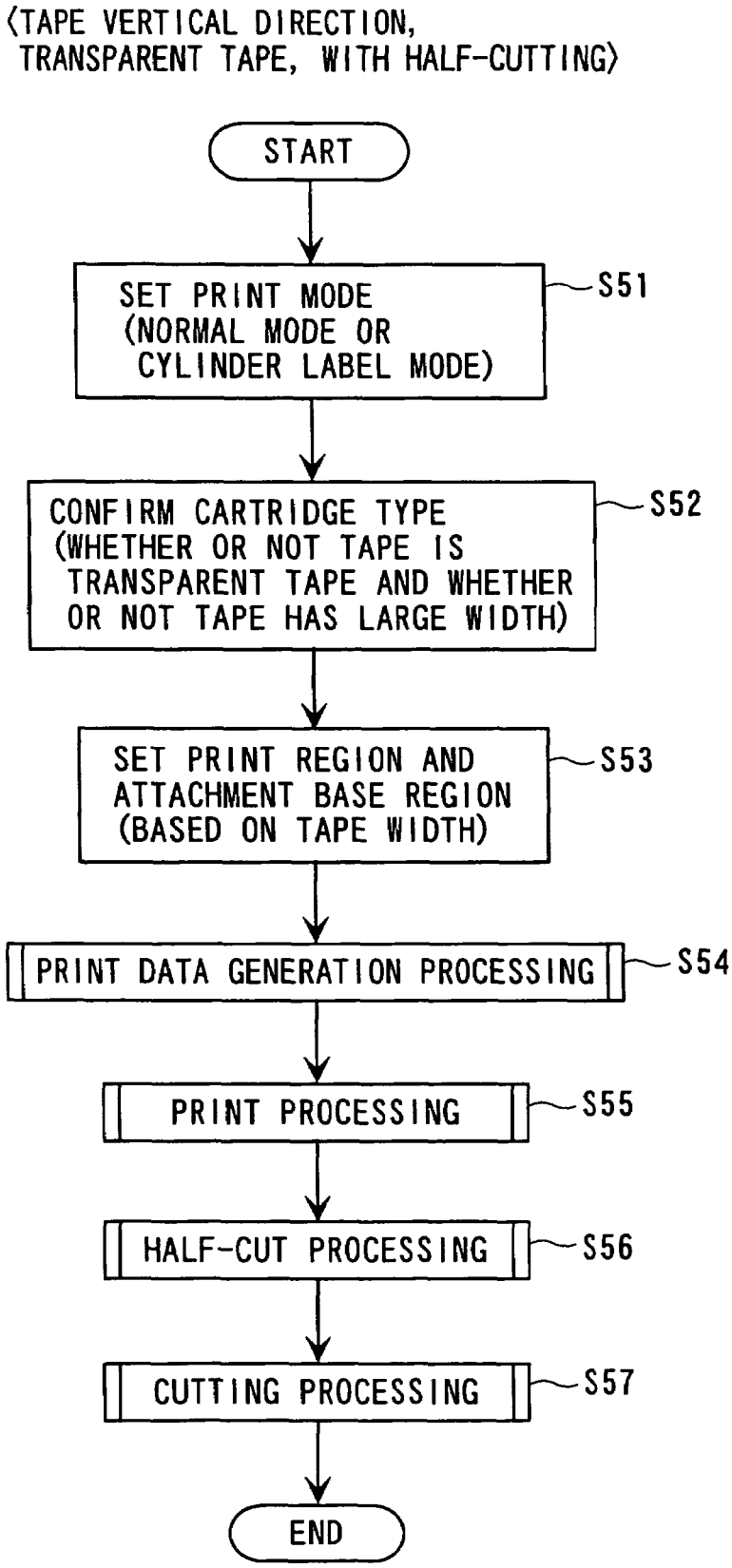
FIG. 10 is a flowchart schematically showing a method for creating a label according to a sixth embodiment of the present invention.
Figure 13A:
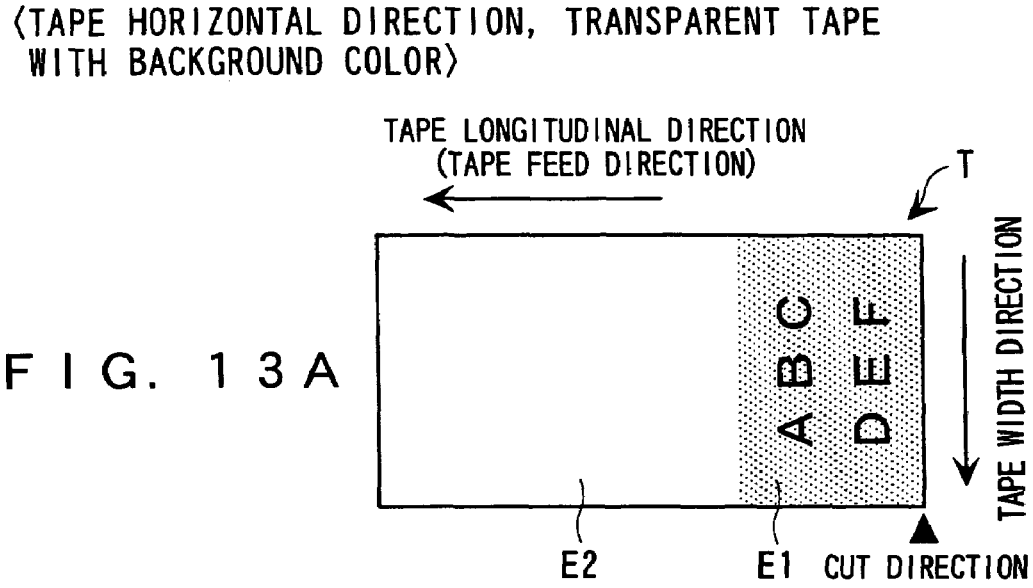
FIGS. 13A and 13B are views showing printed tapes according to the fifth and sixth embodiments of the present invention.
Figure 13B:
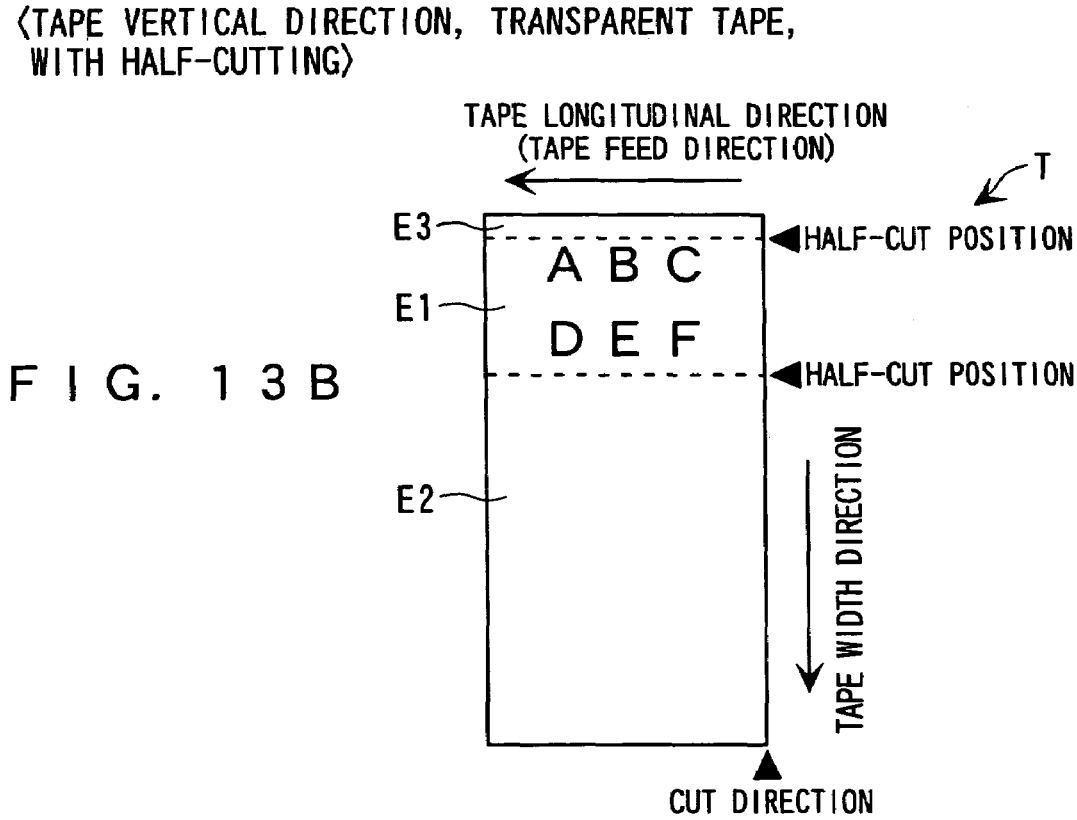

Moreover, in this embodiment, as shown in FIG. 13B, the printing tape T is divided parallel to the longitudinal direction thereof. Thus, in an edge portion at the print region E1 side, an attachment base region E3 is set, which will be a base point in attaching the printing tape T to the object 10. Furthermore, a boundary portion between the attachment base region E3 and the print region E1 is half-cut. Accordingly, with this arrangement, the release paper layer in the non-print region E2 and the attachment base region E3 is released (see FIGS. 14A and 14B) and the tape is attached around the object 10 while using the attachment base region E3 as the base point. Thus, the label can be easily and accurately attached without displacing the base point. Here, with a focus on a difference between the sixth embodiment and the above-described embodiments, the sixth embodiment will be described below with reference to a flowchart shown in FIG. 10 and a printed tape shown in FIG. 13B. The printing tape T used in this embodiment is the same as that of the first embodiment, which is entirely translucent (see FIG. 20A).

First, when the print mode key is pressed by the user to set the print mode to the cylinder label mode (S51), the cartridge type is detected by the microswitches 23 (S52). Here, it is detected whether or not the printing tape is a transparent tape and whether or not the printing tape has a large width. When the printing tape T is not the transparent tape and when the tape width is 24 mm or less, an error display is performed on the display screen 5*a*.

Next, in accordance with the tape width of the printing tape T housed in the detected tape cartridge C, the print region E1 and the attachment base region E3 are set (S53). Subsequently, characters are inputted from the keyboard 3 by the user to generate print data (S54). Here, although there is no limitation on the number of characters per line, the number of lines is limited according to the tape width.

Next, printing is performed in the set print region E1 based on the generated print data (S55). Subsequently, the boundary portion between the attachment base region E3 and the print region E1 and the boundary portion between the print region E1 and the non-print region E2 are half-cut (S56). Thereafter, a tape rear end portion is cut off in the tape width direction so as to have a length corresponding to the print data (S57). Half-cutting is performed by using a roller-type cutter. However, the printing tape may be half-cut at predetermined positions by providing a half-cut mechanism on the printer and mounting (inserting) a label after being cut into the half-cut mechanism. Moreover, half-cutting may be performed in a manner synchronized with a print operation. Thus, a label created by using the method described above is one as shown in FIG. 13B.

As described above, according to this embodiment, the boundary portion between the print region E1 and the non-print region E2 is half-cut in the longitudinal direction of the printing tape T. Thus, if the release paper layer in the non-print region E2 is released and the tape is attached in such a manner that the print region E1 is overlaid with the non-print region E2, the release paper layer becomes a base in the print region E1. Consequently, even if the entire surface of the tape is translucent, visibility of printed characters and images is not diminished by a color of the object 10. Moreover, the attachment base region E3 to be the base point in attaching the printing tape T to the object 10 is set and the boundary portion between the attachment base region E3 and the print region E1 is further half-cut. Thus, it is possible to create a label which can be easily and accurately attached without displacing the base point. It is also possible to set only the two regions, print and non-print regions E1 and E2, without providing the attachment base region E3.

Figure 14A:
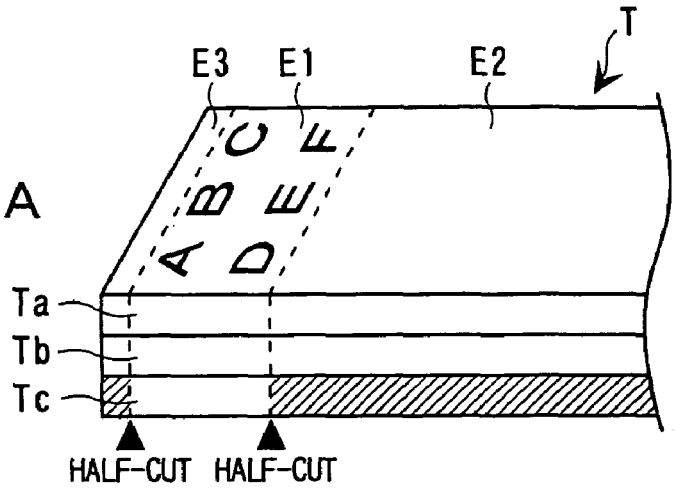
FIGS. 14A to 14C are views showing printed tapes according to the sixth and other embodiments of the present invention.
Figure 14B:
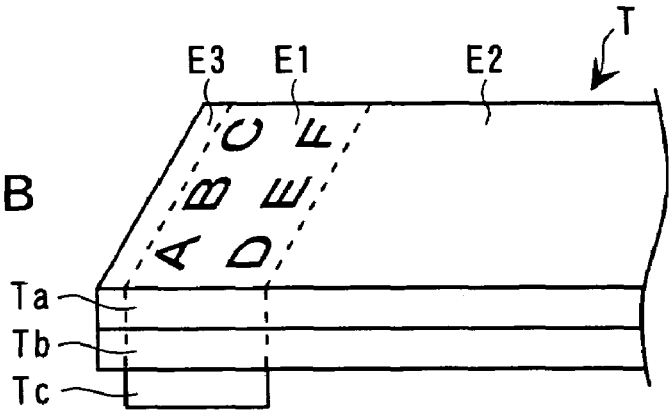
Figure 14C:
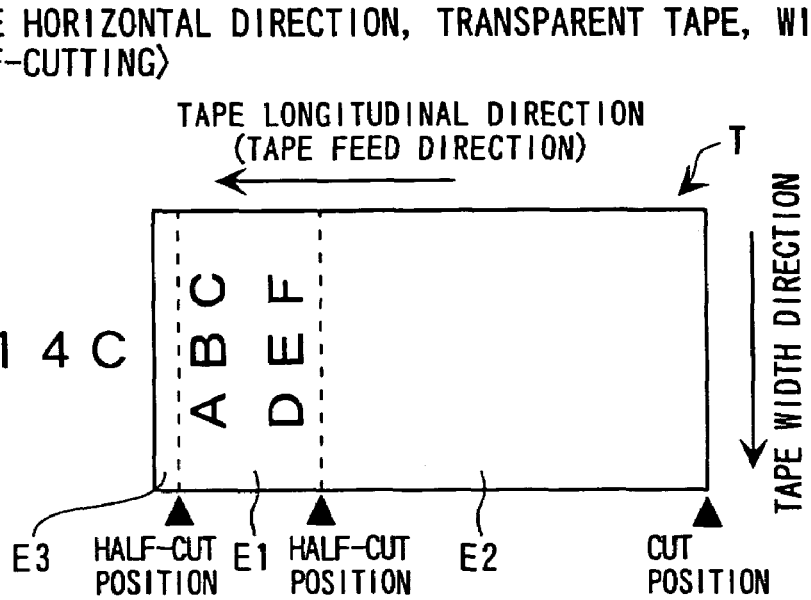

Here, a method for creating a label according to another embodiment, which is different from the foregoing embodiments, will be briefly described with reference to a printed tape. First, FIG. 14C shows one obtained by half-cutting the boundary portion between the print region E1 and the non-print region E2 after printing, similar to the sixth embodiment. However, the one shown in FIG. 14C is different from that of the sixth embodiment in that the tape is half-cut in the tape longitudinal direction. In such a manner, by dividing the respective regions parallel to the tape width direction, half-cut processing can be easily performed. Moreover, in this case, if the tape is half-cut by using the tape cutter 9 for cutting processing, the mechanism for half-cutting can be omitted. Moreover, since the length of the tape in the longitudinal direction can be arbitrarily set, the tape can also be attached to the object 10 having a large diameter.

Figure 15A:
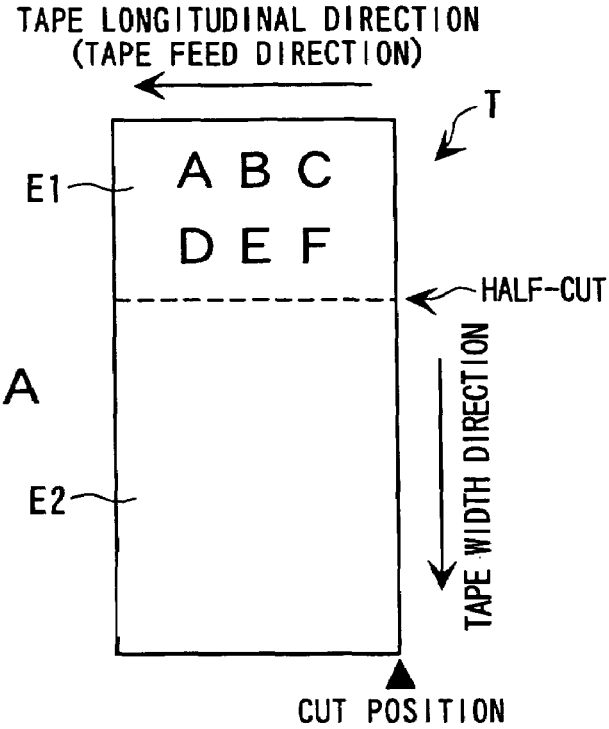
FIGS. 15A and 15B are views showing printed tapes according to another embodiment of the present invention.
Figure 15B:
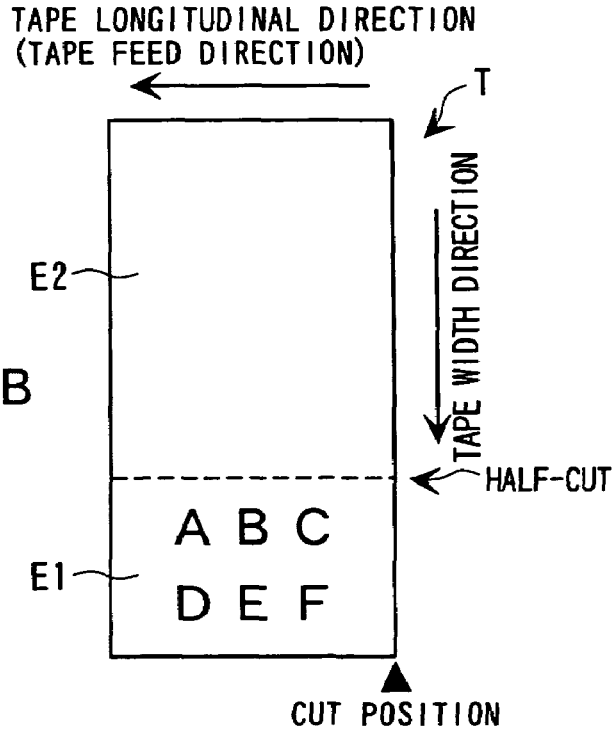

Further, FIG. 15A shows one obtained by half-cutting the boundary portion between the print region E1 and the non-print region E2 parallel to the longitudinal direction, similar to the sixth embodiment. The one shown in FIG. 15A is different from that of the sixth embodiment in that the printing tape T is previously half-cut. Therefore, a printing tape T previously subjected to half-cut processing (see FIG. 20D) is provided in a state where the tape is rolled and housed in the tape cartridge C. Thus, it is possible to save the trouble of carrying out the half-cut processing. In addition, even if the entire surface of the tape is translucent, visibility of printed characters and images is not diminished by a color of the object 10 to be a base. Moreover, as shown in FIG. 20E, by using the printing tape T which includes the attachment base region E3 and allows the boundary portion between the attachment base region E3 and the print region E1 to be further half-cut, it is possible to easily and accurately attach the tape without displacing the base point. As shown in FIG. 15B, also in this case, it is possible to change the disposition of the print region E1 and the non-print region E2 and to dispose the print region E1 in, a tape lower end portion.

Figure 16A:
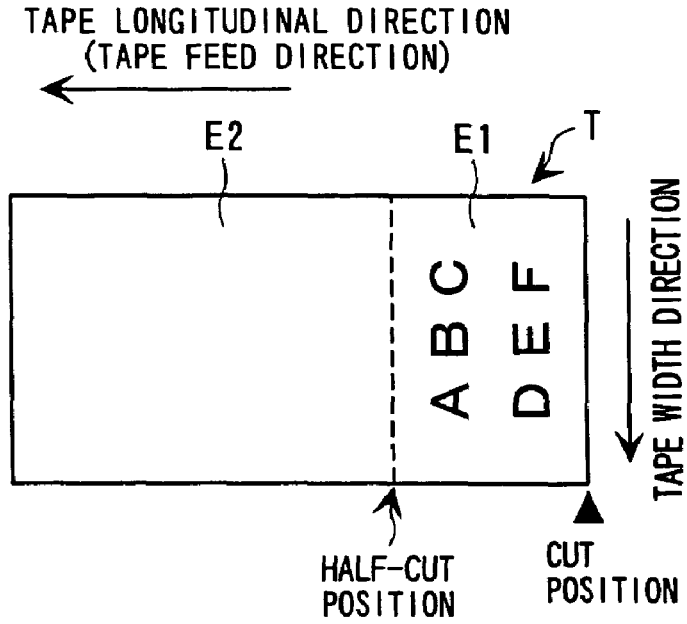
FIGS. 16A and 16B are views showing printed tapes according to another embodiment of the present invention.
Figure 16B:
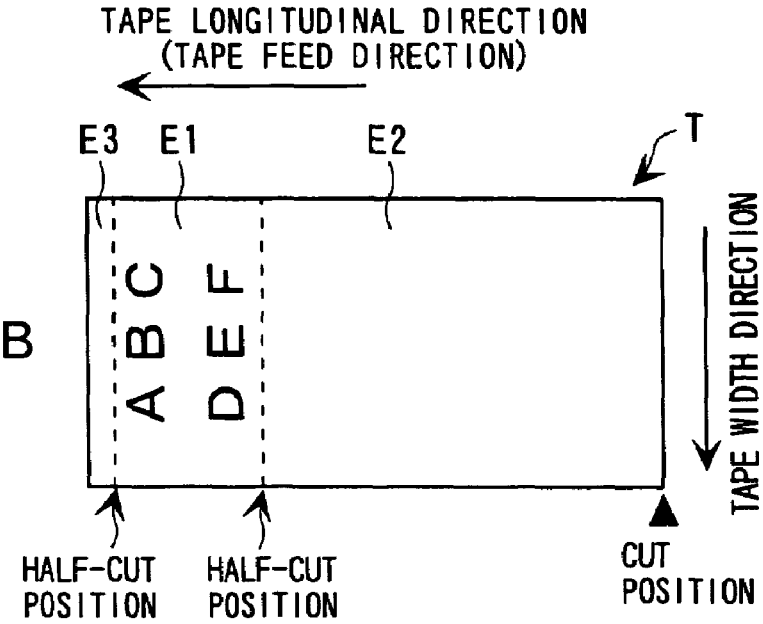

Further, FIG. 16A shows one obtained by previously half-cutting the boundary portion between the print region E1 and the non-print region E2, similar to the case shown in FIG. 15A. However, the one shown in FIG. 16A is different from that of FIG. 15A in that the tape is half-cut parallel to the tape width direction. In this case, as shown in FIG. 20F, the tape is half-cut at predetermined intervals and cut positions are determined. Similar to the case described above, also in this case, it is possible to save the trouble of performing the half-cut processing. In addition, an effect is achieved that, even if the entire surface of the tape is translucent, visibility of printed characters and images is not diminished by a color of the object 10 to be a base. Moreover, as shown in FIG. 20G, by using a printing tape T which includes the attachment base region E3 and allows the boundary portion between the attachment base region E3 and the print region E1 to be further half-cut parallel to the width direction, the tape can be easily and accurately attached without displacing the base point. A printed tape in the case of using the above-described printing tape T is one as shown in FIG. 16B. As described above, it is also possible to change the disposition of the print region E1 and the non-print region E2 and to include the attachment base region E3.

Figure 17A:
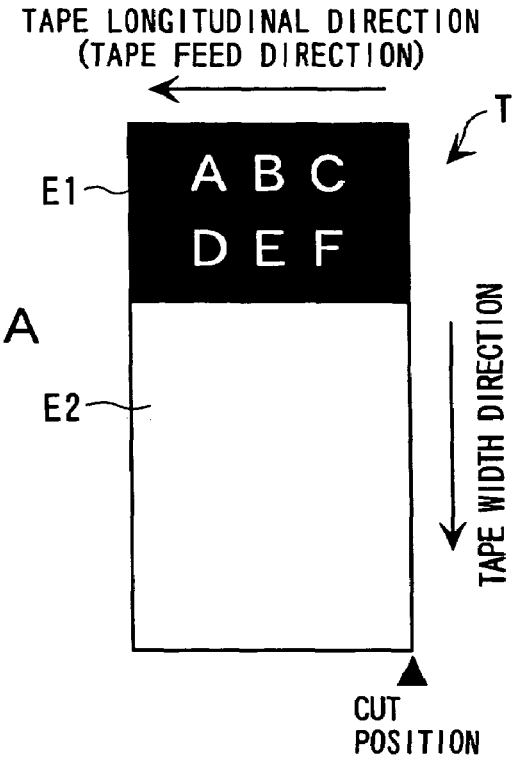
FIGS. 17A and 17B are views showing printed tapes according to another embodiment of the present invention.

FIG. 17A shows one obtained by reverse printing characters in the print region E1. An ink of the ink ribbon R is not applied to a portion of characters (letters) and the ink is applied to a portion outside the characters (a background portion). With this arrangement, the boundary portion between the print region E1 and the non-print region E2 is made clear. In addition, compared to the case where only the character (letter) portion is printed, visibility of letters and images can be improved without being influenced by a color of the object 10 to be a base.

Figure 17B:
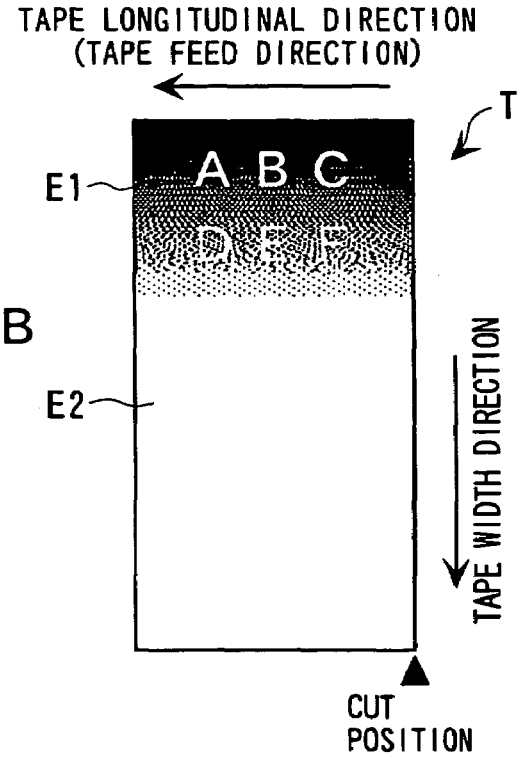

FIG. 17B shows one obtained by subjecting the portion outside characters in the print region E1 to gradation printing so as to be faded toward the non-print region E2 (toward a lower side in FIG. 17B). With this arrangement, when the diameter of the object 10 is small, even if the tape is attached in such a manner that the vicinity of a lower side of the print region E1 overlaps with the vicinity of an upper side of the print region E1, the portion outside characters (a background portion) in the vicinity of the lower side is printed in a light color. Thus, visibility in the vicinity of the upper side is not diminished. Therefore, it is possible to set the print region E1 to be wide.

Next, with reference to FIGS. 18A to 18C and FIGS. 19A and 19B, a tape cartridge arrangement and a printer arrangement according to another embodiment of the present invention will be briefly described. In the embodiments described above, the arrangement is adopted, in which the width of the tape housed in the tape cartridge C and the width of the ink ribbon have the same length. As shown in the pattern A of FIG. 18A, the width of the ink ribbon R may be set to an equal length to that of the print region E1 in the tape width direction (however, this is limited to the case where the printing tape T is divided parallel to the longitudinal direction, i.e., the case of using the printing tape T in the longitudinal direction). With this arrangement, the ink ribbon R having the same width as a tape width including the width of the non-print region E2 is not required. Thus, costs required for the ink ribbon R can be reduced.

Figure 18A:
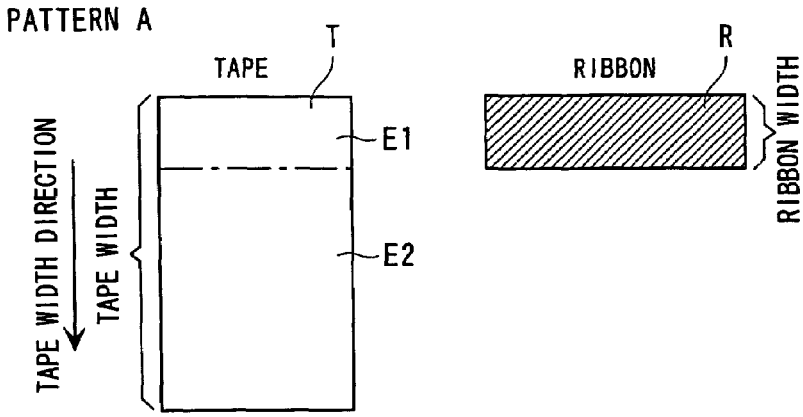
FIGS. 18A to 18C are views showing arrangements of a printing tape and an ink ribbon according to another embodiment of the present invention.
Figure 18B:
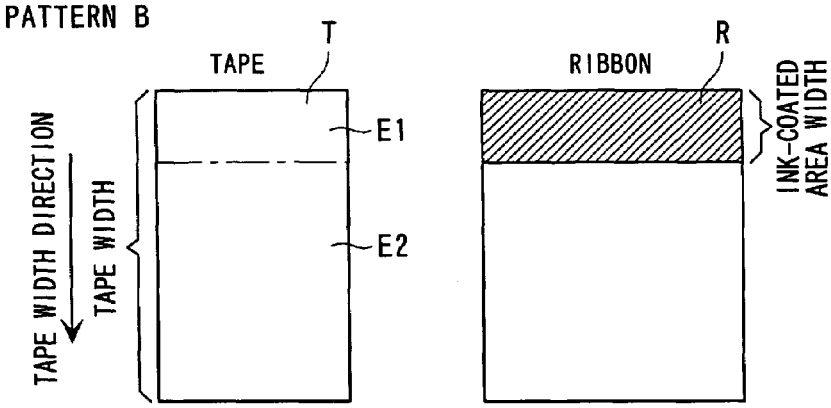

Further, as shown in the pattern B of FIG. 18B, the ribbon width itself may have the same length as the tape width and an ink-coated area width of the ink ribbon R may have an equal length as that of the print region E1 in the tape width direction. With this arrangement, it is not required to apply the ink for the same width as the tape width including the width of the non-print region E2. Thus, the costs required for the ink ribbon R can be reduced.

Figure 18C:
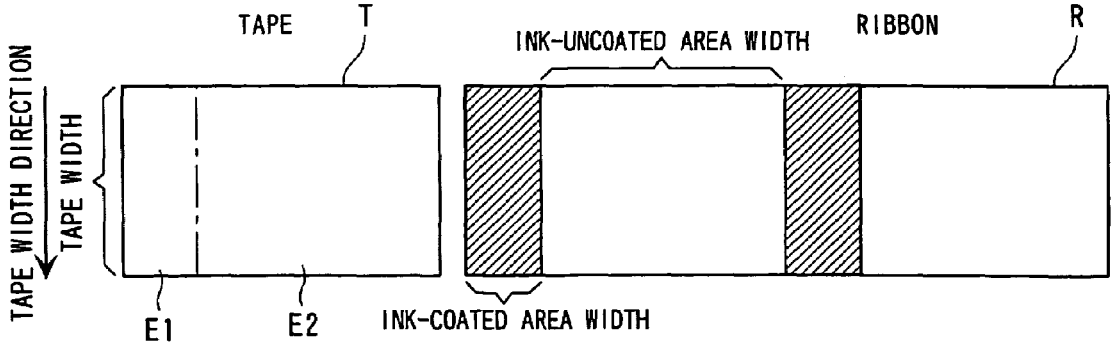

As shown in the pattern C of FIG. 18C, also in the case of dividing the printing tape T parallel to the width direction thereof, the ink-coated area of the ink ribbon R may have an equal length as that of the print region E1 in the tape longitudinal direction and an ink-uncoated area may have an equal length as that of the non-print region E2 in the tape longitudinal direction. Similar to the above-described example, also in this case, the costs required for the ink ribbon R can be reduced.

Figure 19A:
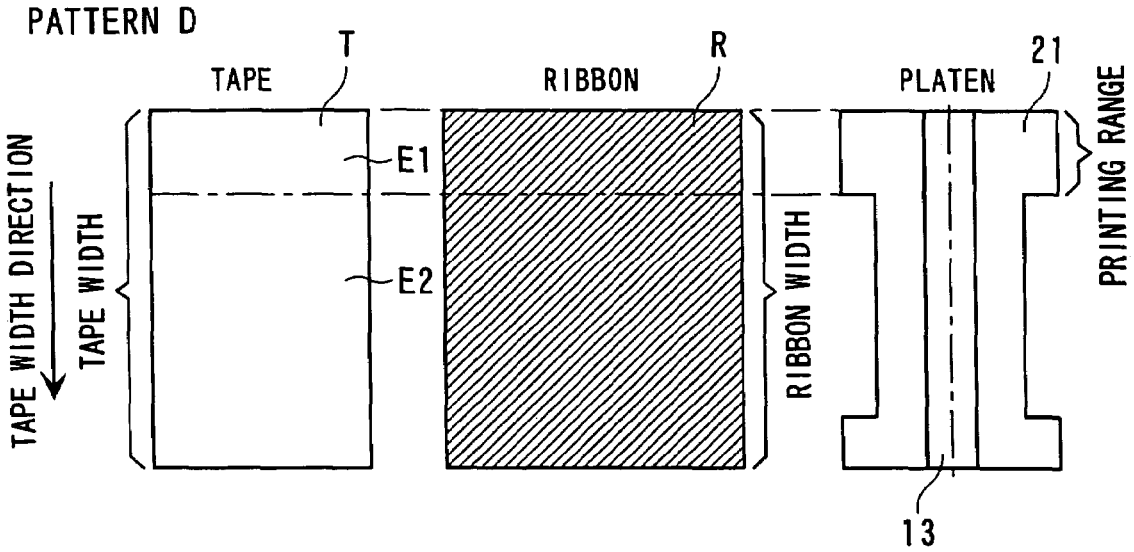
FIGS. 19A and 19B are views showing arrangements of a printing tape, an ink ribbon, a platen and a print head according to another embodiment of the present invention.

Moreover, as shown in the pattern D of FIG. 19A, a width of a press region where the printing tape T is pressed by the platen 21 (platen roller) may be set equal to the length of the print region E1 in the tape width direction. Specifically, the platen 21 faces the print head (thermal head 12) and presses the printing tape T against the thermal head 12 in printing. With this arrangement, a platen roller having the same width as the tape width including the width of the non-print region E2 is not required. Consequently, the platen roller can be miniaturized and thus the tape cartridge C can be miniaturized.

Figure 19B:
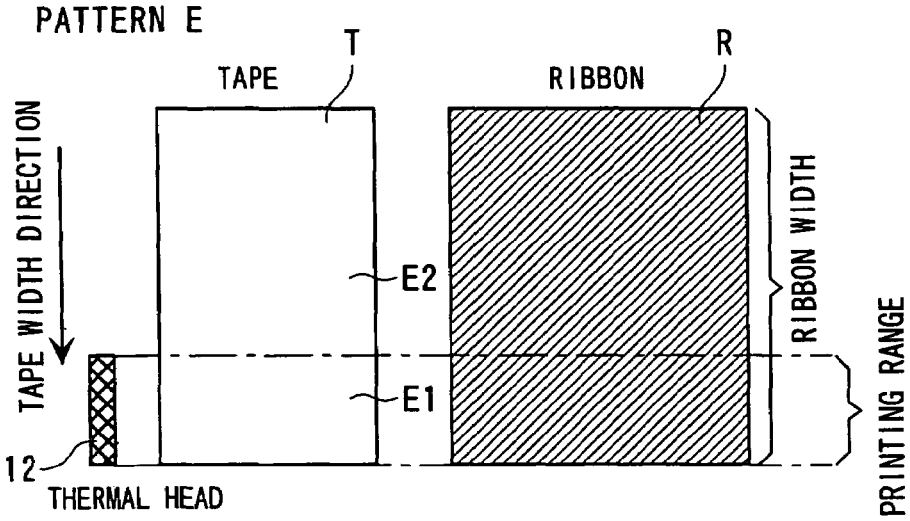

Moreover, as shown in the pattern E of FIG. 19B, a width of a press region where the printing tape T is pressed by the thermal head 12 disposed in the tape printing apparatus 1 may have an equal length to that of the print region E1 in the tape width direction. With this arrangement, the thermal head 12 having the same width as the tape width including the width of the non-print region E2 is not required. Thus, costs for manufacturing the thermal head can be reduced.

As described above, by using the tape printing apparatus 1 according to the present invention, in attaching the label around the linear or bar-shaped object 10 from the edge portion of the printed tape part in the width direction, the print region E1 is set so as to be overlaid with the non-print region E2 that is the non-print part. Thus, the abrasion resistance and the rubfastness of the label (the print region E1) can be improved. Moreover, by using the printing tape T having translucency, visibility of the print region E1 is not diminished.

Moreover, the printing tape T having the background color region and the transparent region is used (see FIGS. 20B and 20C) and printing is performed in the print region E1 having the background color. Thus, visibility of printed characters and images is not diminished by a color of the object 10 to be a base. Furthermore, by using the printing tape T which is divided parallel to the width direction thereof, the length thereof in the longitudinal direction can be arbitrarily set. Thus, it is possible to create a label which can also be attached to the object 10 having a large diameter.

In addition, the length of the print region E1 and/or the length of the non-print region in the longitudinal direction are set based on the generated print data or the inputted object size. Thus, even if the number of characters to be printed is large or the diameter of the object 10 is large, the print region E1 can be set so as to be surely overlaid with the non-print region E2. Furthermore, the print region E1 is disposed on the upstream side of the non-print region E2 along the feed direction of the printing tape T. Thus, printing can be performed up to the vicinity of the tape end (the tape rear end) without wasting the printing tape T.

Moreover, the boundary portion between the print region E1 and the non-print region E2 is half-cut, the release paper layer only in the non-print region E2 is released and the tape is attached in such a manner that the print region E1 is overlaid with the non-print region E2. Accordingly, the release paper layer becomes a base in the print region E1. Thus, even if the entire surface of the tape is translucent, visibility of printed characters and images is not diminished by a color of the object 10. Moreover, the attachment base region E3 is set in the edge portion at the print region E1 side, the attachment base region E3 being the base point in attaching the printing tape T to the object 10, and the boundary portion between the attachment base region E3 and the print region E1 is further half-cut. Thereafter, the release paper layer in the non-print region E2 and the attachment base region E3 is released and the tape is attached around the object 10 in a state where the attachment base region E3 is set as the base point. Thus, the label can be easily and accurately attached without displacing the base point.

Moreover, by using the printing tape T previously subjected to half-cutting, it is possible to save the trouble of performing half-cutting. In addition, it is possible to create a label which can be easily and accurately attached.

The present invention is not limited to the above-described embodiments. Without departing from the scope of the present invention, changes in the method for setting the print mode, the print procedures and the like can be appropriately made.

As described above, by using the tape printing apparatus and the tape cartridge according to the present invention, operations and effects are achieved, such that a label to be attached to a linear or bar-shaped object, the label being excellent in abrasion resistance and rubfastness, can be easily created.

What is claimed is:

1. A tape cartridge which houses a translucent printing tape in its rolled state, the printing tape becoming a label to be attached to a linear or bar-shaped object when a printed tape part is cut off in its width direction after printing, wherein the printing tape is divided parallel to its longitudinal direction into a print region where printing is performed and a non-print region where printing is forbidden, wherein a boundary portion between the print region and the non-print region is half-cut, an ink ribbon for transferring ink onto the printing tape, and wherein the ink ribbon is housed in the tape cartridge in its rolled state and a width of the ink ribbon is equal to a length of the print region in a tape width direction.

2. A tape cartridge which houses a translucent printing tape in its rolled state, the printing tape becoming a label to be attached to a linear or bar-shaped object when a printed tape part is cut off in its width direction after printing, wherein the printing tape is divided parallel to its longitudinal direction into a print region where printing is performed and a non-print region where printing is forbidden, wherein a boundary portion between the print region and the non-print region is half-cut, an ink ribbon for transferring ink onto the printing tape, and wherein the ink ribbon is housed in the tape cartridge in its rolled state and a width of an ink-coated area is equal to a length of the print region in a tape width direction.

3. A tape cartridge which houses a translucent printing tape in its rolled state, the printing tape becoming a label to be attached to a linear or bar-shaped object when a printed tape part is cut off in its width direction after printing, wherein the printing tape is divided parallel to its longitudinal direction into a print region where printing is performed and a non-print region where printing is forbidden, wherein a boundary portion between the print region and the non-print region is half-cut, a platen roller which faces a print head and presses the printing tape against the print head in printing, and wherein a width of a press region in which the platen roller presses the printing tape is equal to a length of the print region in a tape width direction.

* * * * *

UNITED STATES PATENT AND TRADEMARK OFFICE

CERTIFICATE OF CORRECTION

PATENT NO. : 7,278,797 B2
APPLICATION NO. : 11/150531
DATED : October 9, 2007
INVENTOR(S) : Akaiwa et al.

It is certified that error appears in the above-identified patent and that said Letters Patent is hereby corrected as shown below:

Title Page item 73, delete "King Jim Co., Ltd., Tokyo (JP)"

Signed and Sealed this

Nineteenth Day of August, 2008

JON W. DUDAS
*Director of the United States Patent and Trademark Office*